US009622627B2

(12) United States Patent
Wilson et al.

(10) Patent No.: US 9,622,627 B2
(45) Date of Patent: Apr. 18, 2017

(54) TABLETOP NAPKIN DISPENSER

(75) Inventors: Rodney Wilson, Wilmington, DE (US); Leo Gonzales, West Chester, PA (US); Justin Siebel, Chatham, NJ (US)

(73) Assignee: SCA HYGIENE PRODUCTS AB, Göteborg (SE)

( * ) Notice: Subject to any disclaimer, the term of this patent is extended or adjusted under 35 U.S.C. 154(b) by 284 days.

(21) Appl. No.: 14/355,039

(22) PCT Filed: Oct. 31, 2011

(86) PCT No.: PCT/EP2011/069116

§ 371 (c)(1),
(2), (4) Date: Oct. 29, 2014

(87) PCT Pub. No.: WO2013/064165

PCT Pub. Date: May 10, 2013

(65) Prior Publication Data

US 2015/0048104 A1 Feb. 19, 2015

(51) Int. Cl.

| | |
|---|---|
| ***A47K 10/20*** | (2006.01) |
| ***A47K 10/42*** | (2006.01) |
| *A47K 10/32* | (2006.01) |

(52) U.S. Cl.

CPC ..... *A47K 10/427* (2013.01); *A47K 10/422* (2013.01); *A47K 2010/3246* (2013.01)

(58) Field of Classification Search

CPC ..... A47K 10/20; A47K 10/427

(Continued)

(56) References Cited

U.S. PATENT DOCUMENTS 2,081,564 A 5/1937 Tuszynski
4,311,252 A * 1/1982 Hope, Jr. ..... A47K 10/422 221/57

(Continued)

FOREIGN PATENT DOCUMENTS

CN 1257413 A 6/2000
CN 2546386 Y 4/2003

(Continued)

OTHER PUBLICATIONS

English-language translation on a Chinese Second Office Action dated Jun. 29, 2016 issued in corresponding Chinese patent application No. 201180074619.1 (13 pages).

(Continued)

*Primary Examiner* — Patrick Mackey
(74) *Attorney, Agent, or Firm* — Drinker Biddle & Reath LLP

(57) ABSTRACT

A napkin assembly including an open ended chute for storing a stack of napkins therein and an openable and closeable front member relative to the open end of the chute is disclosed. The chute is made of first to fourth sidewall members and a rear member that are separately injection molded pieces that include a clip structure for clipping the pieces together. Opposed ones of the sidewall members are identical pieces allowing them to be interchanged with one another during manufacture. The front member includes a transparent window to allow a depth of the stack to be viewed from the outside. The front member includes locking tabs to lock it in a closed position relative to the chute. The tabs may be flexed through openings in the chute from the outside into a lock release position. The chute includes blocking members to prevent over inward deflection of the locking tabs.

20 Claims, 8 Drawing Sheets

(58) Field of Classification Search
USPC ..... 221/45
See application file for complete search history.

(56) References Cited

U.S. PATENT DOCUMENTS

| | | | | |
|---|---|---|---|---|
| 4,953,747 | A * | 9/1990 | Wenkman | A47K 10/427 221/305 |
| 5,131,561 | A | 7/1992 | Casperson et al. | |
| 1,257,413 | A1 | 3/2001 | Hill | |
| 7,178,689 | B2 * | 2/2007 | Wieser | A47K 10/422 221/45 |
| 7,661,553 | B2 * | 2/2010 | Zeiron | A47K 10/427 221/305 |
| 2003/0057221 | A1 | 3/2003 | Guillemette et al. | |
| 2004/0222582 | A1 | 11/2004 | Widlund | |
| 2005/0199643 | A1 | 9/2005 | Smiley et al. | |
| 2006/0086748 | A1 * | 4/2006 | Burns | A47K 10/426 221/35 |
| 2006/0102641 | A1 * | 5/2006 | Cittadino | A47K 10/422 221/45 |
| 2006/0273100 | A1 | 12/2006 | Cittadino et al. | |
| 2006/0273102 | A1 | 12/2006 | Wieser et al. | |
| 2007/0034638 | A1 | 2/2007 | Zeiron | |
| 2009/0277920 | A1 | 11/2009 | Cittadino et al. | |
| 2011/0095042 | A1 | 4/2011 | Bandoh | |

FOREIGN PATENT DOCUMENTS

| | | | |
|---|---|---|---|
| CN | 101186075 | A | 5/2008 |
| CN | 101983027 | A | 3/2011 |
| EP | 1656870 | A2 | 5/2006 |
| EP | 1693304 | A1 | 8/2006 |
| SE | 0301297 | A | 11/2004 |
| WO | WO-2005/107546 | A1 | 11/2005 |
| WO | WO-2005/107548 | A1 | 11/2005 |
| WO | WO-2006-132618 | A1 | 12/2006 |
| WO | WO-2013/055340 | A1 | 4/2013 |

OTHER PUBLICATIONS

English language translation of an Chinese Office Action dated Nov. 3, 2015 issued in corresponding Chinese Patent Application No. 201180074619.1 (6 pages).

Extended European Search Report dated Mar. 6, 2015 issued in corresponding European patent application No. 14194473.6 (6 pages).

* cited by examiner

TABLETOP NAPKIN DISPENSER

CROSS-REFERENCE TO PRIOR APPLICATION

This application is a §371 National Stage Application of PCT International Application No. PCT/EP2011/069116 filed Oct. 31, 2011, which is incorporated herein in its entirety.

TECHNICAL FIELD

The present disclosure is concerned with a tabletop napkin dispenser, which is a dispenser for dispensing napkins that is designed to be placed on the top of a table or counter or the like so that a user can withdraw napkins from the confines of the dispenser in a one-at-a-time fashion through a dispensing opening. The napkin dispenser includes a housing defining a product reservoir for receiving a stack of napkins. The napkins are generally interfolded so that withdrawing one napkin causes the next napkin to be partly pulled through the dispensing opening.

BACKGROUND

There is known from WO 2006/132618 a tabletop napkin dispenser that is intended to be stood on a rear face so that a front face including a dispensing opening faces upwards. The dispenser has side faces connecting the front and rear faces of a height such that the dispenser is able to accommodate a stack of about 200 napkins. As such, the height dimension of the napkin dispenser is less than a length direction of a footprint of the dispenser. There is also known from WO 2005/107548 a dispenser able to hold a stack of about 450 napkins, whereby the height dimension from a rear face to an opposing front face including the dispensing opening is greater than a length dimension of the front and rear faces. The dispenser of WO '548 is intended to be laid on its side, specifically on a side face of largest area so that, unlike the device of WO '618, it does not stand on its rear face. The dispenser of WO '618 dispenses vertically, while the dispenser of WO '548 dispenses horizontally. In the following, we will refer to these two types of dispenser as a vertically dispensing tabletop dispenser and a horizontally dispensing tabletop dispenser, respectively.

The vertically dispensing device of WO '618 is made of a base element forming the rear face, a sleeve element forming the side faces of the dispenser and a lid mounted to the sleeve by a hinge. The base element includes upstanding side wall members, two of which cooperate with the sleeve to define a paper thin cavity that is open at a top end for receipt of, e.g., advertising material. The sleeve is thus transparent so that the advertising material can be viewed through it. The other two upstanding side wall members form a catch mechanism with the lid for holding the lid in a closed position.

The base element and the sleeve element clip together on all four sides at the base end of the sleeve. Manufacturing considerations for the device of WO '618 mean that the base element and the sleeve are required to be fairly square, whereas a more rounded shape could be aesthetically preferable.

The lid of the vertically dispensing device of WO '618 is openable and closeable about the hinge. In the open position, a napkin reservoir is accessible for refilling. In the closed position of the lid, the refill access is substantially closed by the lid so that the napkins have to be removed through the dispensing opening defined in the lid. The lid is held in the closed position by resilient catch members extending upwardly from the upstanding side wall members of the base element to engage on corresponding catch members formed inside the lid. A platform fits in the space defined by the sleeve and the side wall members upon which the stack rests. The platform is biased by a spring to the dispensing opening.

To release the catches, the side wall members of the base element have to be pushed inwardly through an archway provided in the sleeve member. Further, when the platform is at an uppermost position adjacent the dispensing opening, which occurs when the stack is low or entirely used up, the platform tends, due to close tolerances, to obstruct inward depression of the upstanding side wall members and the associated catch members. It is desirable to provide an easier to open lid member, once the user knows the knack of doing so.

The upstanding side wall members partly defining the advertising cavity include a thumb sized cut out from an otherwise rectangular member to allow the advertising material to be removed and, perhaps, replaced. The advertising material is thus required to be of a specific size, encouraging the use of a template format for designing the advertising material. It has been found that a more flexible system could be desirable.

In the horizontally dispensing napkin dispenser of WO '548, there is also provided a sleeve member that defines a housing of the dispenser and also defines an internal product reservoir. The sleeve member is clipped to a base member. The sleeve member, and thus an outer appearance of the dispenser, is restricted to being relatively square shaped because of manufacturing considerations, while it has been found that consumers may prefer a more rounded appearance.

The sleeve member defines guide channels that receive guide rails of a drawer. The drawer is guided between a retracted and closed position with respect to the sleeve and an extended position for refilling the drawer with napkins. A front face of the drawer defines a front face of the dispenser and includes a dispensing opening. The drawer is held closed in the retracted position by a catch mechanism. The drawer defines a tray with upstanding side and rear walls for receiving the stack of napkins. A transverse panel translatably mounted in the drawer is provided to bias the stack toward the dispensing opening. It has been found that the biasing configuration disclosed in WO '548 can in some uses allow the napkins to fall away from the dispensing opening as the stack nears a fully depleted state. It has been found that a more consistent biasing configuration could be useful in some instances.

The dispenser of WO '548 has been designed purely for horizontal dispensing. It has been found that a dispenser of this kind, with a drawer and a relatively large napkin capacity, that can also dispense vertically would be desirable.

It is desired to overcome the above identified problems or resolve the above identified desirable features.

SUMMARY

According to a first aspect, there is provided a tabletop napkin dispenser including a rear wall member and four side wall members that are mounted to the rear wall member to define an open ended box providing a housing for a stack of napkins and a front member including a dispensing opening that is moveable between an open position with respect to the open ended box to provide access for refilling the napkin dispenser and a closed position to close the open end of the box, wherein the rear wall member and the four side wall members are separate injection molded pieces that are clipped together to form the open ended box.

The napkin dispenser can include rear and side wall members that are separately formed injection molded pieces that are clipped together. This aspect is able to improve the appearance of the napkin dispenser because the formation of the dispenser in separate pieces provides increased design flexibility as compared to an integral construction. For example, a more rounded profile for the napkin box is possible, which has been found to be desirable. Further, manufacturing simplicity is ensured by molding the components so that they clip together.

In an embodiment, the sidewall members include first and second opposed sidewall members that are identical in that they are formed from a same first injection mould and include third and fourth opposed sidewall members that are identical in that they are formed from a same second injection mould, so that the first and second sidewall members are interchangeable with one another in the napkin dispenser during assembly and the third and fourth sidewall members are interchangeable with one another in the napkin dispenser during assembly, yet the first and second sidewall members are not interchangeable with the third and fourth sidewall members in the napkin dispenser during assembly. Such a structure allows a reduced number of injection moulds to be used for manufacture. Further, the assembly process is simplified since it is not necessary to discriminate between the first and second sidewall members and the third and fourth sidewall members. That is, the first and second sidewall members can be taken indiscriminately from the same bin of pieces and the third and fourth sidewall members can be taken indiscriminately from a different bin of pieces.

In more detail, if the first and second sidewall members were interchanged in position with respect to the rear member or the third and further sidewall members were interchanged in position with respect to the rear member, the dimensions of the first and second sidewall members would still match the rear member or the dimensions of the third and fourth sidewall members would still match the dimensions of the rear member and the clip structure of the sidewall members would still match with counterpart clip structure of the rear member and with counterpart clip structure between the sidewall members. If the first sidewall member were interchanged in position with respect to the rear member with the third or fourth sidewall member or the second sidewall member were interchanged in position with respect to the rear member with the third or fourth sidewall members, the dimensions of the first or second sidewall members would not match the dimensions of the rear member and the dimensions of the interchanged sidewall members would not match, and there would be non-matching clip structure between the sidewall members and non-matching clip structure with the rear member.

Put another way, the first and second sidewall members are both left and right hand pieces with respect to the rear member and the third and fourth sidewall members are both left and right hand pieces with respect to the rear member, and they can be interchanged while still allowing the open ended box to be clipped together to the same extent during assembly and without affecting the physical form of the open ended box.

In one embodiment, the first and second sidewall members are of a different size (surface area) from the third and fourth sidewall members. Additionally, or alternatively, the first and second sidewall members define a different clipping structure from the third and fourth sidewall members. That is, the first and second sidewall members include an engagement structure set and the third and fourth sidewall members include a counterpart engagement structure set. In an embodiment, the first and second sidewall members include clip type engagement members (e.g. projections for engaging recesses on an adjacent sidewall member or recesses for receiving projections from an adjacent sidewall member in a resilient manner) on opposing sides of the sidewall member respectively adjacent the third and fourth sidewall members and the third and fourth sidewall members include counterpart engagement members.

In an embodiment, the sidewall members are each symmetrical about a central axis of the respective sidewall member passing in a front to rear direction, which is one way of achieving the desired interchangeability.

In an embodiment, some or all of the pieces are clipped together by way of resilient members including respective projections that snap fit into recesses. Thus, as the pieces are brought together, the resilient member deforms and when the projection is aligned with the recess, the resiliency of the member forces the projection into the recess. Alternatively, some or all of the pieces are clipped together by way of resiliency from the part with the recess, and projections are snap fit into such recesses. That is, the part with the recess resiliently deforms to snap fit the projection into the recess when they are aligned.

In an embodiment, the napkin dispenser includes a platform and a biasing member, the platform being biased by the biasing member toward the dispensing opening so that the platform forces the stack of napkins toward the dispensing opening from a rear side of the stack. The biasing member may be located between the rear member and the platform and biases the platform toward the dispensing opening to ensure that the stack of napkins is always presented adjacent the dispensing opening irrespective of the degree of depletion of the stack. In an embodiment, the platform is provided by a further separate injection molded piece. The biasing member is, in one embodiment, provided by a spring, which may be made of metal.

In an embodiment, at least one of the side wall members is made up of an outer wall member and an inner wall member that define a sheet shaped cavity between them for the receipt of sheet material, wherein the outer wall member is transparent so that the sheet material disposed in the cavity can be viewed from outside of the dispenser through the outer wall member. The separately injection moulded constructions of the napkin dispenser provides a certain design freedom in terms of where to locate the transparent wall portion. In an embodiment, first and second opposed side wall members are opaque and at least one of third and fourth opposed side wall members are transparent, wherein the first, second, third and fourth side wall members are separately injection moulded pieces.

In an embodiment, at least one of the side wall members, and, for example, opposed side wall members, are made up of an inner wall member and an outer wall member that are separately injection molded pieces so as to define a cavity between them for receipt of sheet material, wherein the first and second wall members support the sheet material. The outer wall member is transparent so that the sheet material in the cavity can be viewed from the outside of the napkin dispenser through the outer wall member. In an embodiment, the inner and outer wall members are held together by the inner wall member including structure to engage on the outer side of the outer wall member or the outer wall member including structure to engage on the inner side of the inner wall member. In an embodiment, the structure is brought into engagement by bringing the inner and outer wall members into contacting yet offset relation and moving the inner and outer wall members along the plane of the wall members relative to one another into an aligned position. In an embodiment, the movement is in a front to rear direction. In an embodiment, the inner or outer walls include resilient fingers with projections thereon for receipt in recesses on the other of the inner or outer wall members for locking the aligned position to prevent the reverse movement to the offset to aligned motion. This structure provides a convenient to manufacture way of creating an advertising material cavity.

In one embodiment, the front member is provided by a drawer that is slideable within the open ended box between the open position and the closed position, the drawer defining a tray for receipt of the stack of napkins. The side wall members of the open ended box and the drawer define cooperating guide rails and guide channels for facilitating opening and closing of the drawer. This arrangement provides for a relatively large capacity napkin dispenser. In an embodiment, first and second opposed side wall members each include first and second drawer guide channels or guide rails that are symmetrically disposed on the side wall member with respect to an axis extending between the first and second channels or rails, wherein the axis is centrally disposed with respect to the side wall member. The counterpart guide channels or guide rails of the drawer are engaged with two corresponding guide rails or guide channels respectively provided on opposed side wall members. The other two guide rails or guide channels of the opposed side wall members are free of such engagement. In this way, the side wall member pieces may be clipped into either side of the opposed sides of the dispenser and there will always be a counterpart guide rail or guide channel for the drawer to engage with. Contrast this with a configuration wherein there is just one non-centrally disposed guide rail or guide channel and if the side wall members were formed of separate pieces, there exists the possibility of the opposed guide rails or guide channels not corresponding with one another. In an embodiment, the opposed side wall members each include a pair of guide rails or channels and the drawer includes first and second opposed counterpart channels or rails on opposite sides of the drawers such that the drawer can be mounted to the open ended box in a first configuration to one of the pair of guide rails or channels of the side wall members and in a second upside down configuration to the other of the pair. That is, the opposed side wall members each including the first and second guide rails or channels are interchangeable without misaligning opposed guide rails or channels.

In an alternate embodiment, the front member is provided by a lid member that is pivotably mounted to the open ended box for rotation between the open and closed positions. The lid member can thus be opened for refilling by rotating around the pivot. In an embodiment, the side wall members include first and second opposed side wall members each having first and second pivot members that are symmetrically disposed with respect to an axis passing between the first and second pivot members, wherein the axis is a central axis of the sidewall member, and the lid member is pivotably mounted to two corresponding pivot members respectively on opposed side wall members. In this way, there is no possibility of using the wrong piece and the pivot members on opposite side wall member pieces being non-corresponding. That is, the opposed side wall members each including the first and second pivots are interchangeable without misaligning opposed pivot pairs. The other two pivot members on the opposed side wall members are free of the lid member being pivotably mounted to them.

In an embodiment, the rear wall member defines a flat base part and opposed curved side parts connecting with opposed side walls to give a rounded outer profile to the napkin dispenser. In an embodiment, the flat base part extends to the edge of the rear side wall part at the other two opposed sides. In an embodiment, integrally molded tabs extend from the edge of the flat base part at the two opposed sides that respectively include engagement projections that are snap fit into engagement recesses of opposed side wall members.

In an embodiment, the opposed curved side parts include integrally injection molded engagement projections that snap fit into engagement recesses in the corresponding side wall members. The use of a curved side part for including a projection tab allows an aesthetically pleasing product to be produced in a way that is adapted for injection moulding since the undercut required is able to be performed with such a structure.

In an embodiment, the rear wall member includes upstanding side walls extending along opposed side wall members and are respectively located on the same side of the rear side wall member as the opposed curved side parts of the rear side wall member. Such an upstanding side wall could cover the engagement projections in a front to rear direction or in a direction normal to the flat part of the rear wall member, which would hinder the production of the necessary undercuts to make the engagement projections. In one embodiment, the upstanding side walls are each formed with cut outs to reveal the engagement projection on the curved side parts as viewed in a direction along flat part of the rear wall member. In an embodiment, the cut outs extend to the front edge of the upstanding side walls. In an embodiment, the cut outs reduce in length in a direction along the upstanding side wall from a front end to a rear end of the upstanding side wall.

In an embodiment, the upstanding side walls cooperate with the adjacent side wall member to define a sheet material receiving cavity. This double wall structure allows paper material, advertising material and the like to be inserted into the cavity. In such an embodiment, the side wall member is at least partly, and, in some embodiments, majorly or entirely, transparent so that the sheet material can be viewed through the side wall member from outside the napkin dispenser. The above described cut outs in the upstanding side walls not only allow the engagement projections to be injection molded, but also offer convenient access to remove the sheet material. Further, since the cut outs may extend from the front edge to adjacent the rear edge of the upstanding side walls, different size sheet material may be conveniently removed from the cavity as compared to if just a small size thumb cut out is provided.

In a second aspect, there is provided a tabletop napkin dispenser including a rear wall member, a front member including a dispensing opening and side wall members extending between the rear wall member and the front member that define an interior space for the receipt of a stack of napkins, wherein at least one of the side wall members includes an inner side wall member and an outer side wall member that define a sheet material receiving cavity therebetween and which respectively support an inner surface and an outer surface of the sheet material, wherein the outer side wall member is at least partly see-through so that the sheet material in the cavity can be viewed from outside the napkin dispenser, wherein the inner side wall member is formed with an opening that extends a major amount of the distance from a front edge to a rear edge of the inner side wall member.

In this way, different height sheet materials, e.g. paper or thin (less than 3 mm thick) cardboard sheets or printed sheets or advertising sheets, can be inserted in the sheet cavity and be easily retrieved. A thumb sized opening provides a small tolerance for sheet material height before the sheet material becomes lost in the cavity as it is entirely covered by the inner and outer side wall members.

In an embodiment, the opening is centrally disposed with respect to a direction extending along the side wall member and perpendicular to the rear to front direction. This provides immediate and intuitive access to the sheet material.

If a just fitting rectangle is drawn around the inner side wall member, the opening area forms at least 50% of the inner side wall member. This again enhances flexibility in template design for the sheet material that can also be easily received from the sheet cavity.

In an embodiment, the opening decreases in size from a front end to a rear end of the inner side wall member in a direction extending along the inner side wall member that is perpendicular to the rear to front direction so that a rear end of the inner side wall member is of increased size as compared to the front end. This provides an inner side wall member of increased stability. This is particularly required in a configuration where the rear end of the inner wall member is attached to the rear wall member and the remainder of the inner wall member extends freely in an upstanding, cantilevered way from a general body of the rear wall member.

In an embodiment, the inner side wall member is integrally injection molded with a rear wall member piece and the outer side wall member is a separately injection molded piece. The outer side wall member clips to the rear wall member by way of a projection formed on the rear side wall member engaging with a recess formed in the outer wall member. The projection is revealed by the opening in the inner side wall member when viewed in a direction extending along a flat base of the rear wall member. That is, rear wall member includes a portion extending above the bottom of the opening in the rear to front direction on the outside of the inner wall member that includes the projection that clips into the recess in the outer wall member. The projection is formed on an inside surface of said portion of the rear wall member. The opening thus provides space for forming the projection during the injection molding process.

In an embodiment, the dispenser includes a platform that is reciprocal in the front to rear direction and which is for seating the stack of napkins on, and further includes a biasing member for biasing the platform toward the dispensing opening to present the stack of napkins at the dispensing opening by moving the platform under the biasing force toward the dispensing opening as the stack depletes.

In an embodiment, the opening splits the inner side wall member into first and second distinct parts. In an embodiment, the first part and second part respectively include a guide rib or channel that extends in the rear to front direction and cooperates with a guide channel or rib of the platform to guide reciprocal movement of the platform from a rear of the dispenser to a front of the dispenser.

In an embodiment, the inner wall member includes side extensions so that the cavity is closed at the sides as well as at the rear end, whereas it is open at the front end for receipt of the sheet material.

In an embodiment, there is provided a plurality of projections extending from the inner wall member toward the outer wall member at a rear end of the inner wall member that define flat surfaces with respect to a flat outer surface of a rear wall member that extends parallel to a flat tabletop surface, wherein the flat surfaces provide a seat upon which a rear end of the sheet material rests in the cavity. In an embodiment, the plurality of projections are part of reinforcing ribs extending in a rear to front direction for reinforcing the inner sidewall member as it freely projects from the rear wall member. The embodiments mentioned in this paragraph are independently applicable from the opening feature of the second aspect. They are advantageous as they provide a simple way of reinforcing the inner wall member and providing a seat for the sheet material in terms of manufacturing the dispenser.

In an embodiment, the front member is provided by a lid member that is pivotably connected to the side wall members so as to be rotatable from an open position in which the interior space is accessible for refilling the napkins and a closed position in which the interior space is closed and the napkins are to be withdrawn through the dispensing opening defined by the lid member.

In an embodiment, an opposed side wall member to said at least one side wall member defines such a sheet material cavity and such an opening therein. In this way, opposed side wall members are able to accommodate advertising material or the like in the cavity so that the material can be viewed through outer wall member from both sides. Further, the advertising material can be of variable heights due to the advantageous configuration of the opening described above.

In an embodiment, the inner side wall member is made of an opaque material. In an embodiment, the inner side wall member extends normally from a flat interior facing surface of the wall member of the dispenser and is integrally injection moulded therewith. The injection moulding material is opaque.

In a third aspect, there is provided a tabletop napkin dispenser including a lid member and an open ended housing defining an interior space for housing a stack of napkins, wherein the lid member includes a dispensing opening, and wherein the lid member is moveable from an open position for providing access to refill napkins in the interior space and a closed position to close the open end of the housing, wherein the lid member or the housing includes at least one tab or resilient arm extending away from the lid member or the housing towards the other of the lid member or the housing and the other of lid member or the housing includes a through opening into which a projection of the tab or resilient arm resiliently snaps to hold the lid member in the closed position, wherein the projection can be pushed on from outside of the napkin dispenser and moved through the opening to resiliently deflect the tab interiorly to disengage the projection and the opening to allow the lid member to be opened.

According to this aspect, the mechanism for unlocking the lid member is more intuitive and can involve less force than a mechanism described above with respect to the prior art in which a whole side wall has to be deflected, once the user knows the knack of operating the unlocking mechanism.

In an embodiment, the tab member is attached at one end to the lid member or the housing and projects freely therefrom and includes an arm portion in the direction of projection and a projection portion defining the projection for engaging the recess at the distal end of the arm portion. This structure offers an easy to deflect configuration.

In an embodiment, the napkin dispenser includes a platform upon which the stack is to seat that is reciprocal within the housing from a retracted position relative to the dispensing opening to an adjacent most position relative to the dispensing opening in a rear to front direction. In an embodiment, the napkin dispenser includes a biasing means, such as a spring, for biasing the platform from the retracted position to the adjacent most position.

In an embodiment, the platform is arranged so that the tab deflects to disengage the projection from the opening in a way that is clear of the platform in the adjacent most position. This feature serves to ease unlocking of the lid member as compared to the prior art arrangement whereby the deflection portion is obstructed by the platform.

In one embodiment, the tab depends from the lid member and the opening is provided in the housing. In one embodiment, the through opening is located in the housing above the plane of the platform in the rear to front direction when the platform is in the adjacent most position.

In one embodiment, the lid member is pivotably connected to the open ended housing and is rotatable about the pivot between the closed and open positions. In an embodiment, the tab or opposed such tabs are provided on the side of the lid member or housing at a central location perpendicular to the pivot axis. In an embodiment, there is first and second such tabs and through openings that are positioned on the housing or the lid member at opposite ends of a line extending from one side of the dispenser to the other in parallel with the pivot axis.

Alternatively put, in one embodiment, the housing includes a rear face and four side faces, two larger than the other two to define an open ended oblong. In an embodiment, tabs or openings are provided on opposing smaller side faces. In one embodiment, the lid member is pivotally connected at each end to the opposing smaller faces. The pivotal connection is located at a corner portion of the smaller faces, while the through openings or tabs are located at a central region of the smaller faces.

In one embodiment, the housing includes opposed sidewalls each defining a channel defined between first and second ribs extending in the rear to front direction. Opposed sides of the platform each include first and second projecting tabs that are guided by the ribs on the outside of the channel. This arrangement provides for stable guiding of the platform. The tabs are part of an outer perimeter shape of the platform. In an embodiment, the first and second tabs include protrusions that extend toward the guide ribs so as to reduce the contact area with the guide ribs to improve the feel of the movement of the platform.

Put another way, the platform includes first and second notches extending through the thickness of the platform at each of opposed sides thereof for receiving first and second guide ribs of corresponding opposed side wall members, thereby guiding the movement of the platform. The first and second guide ribs extend from a rear end of the housing to a front end portion and define a channel between them. The platform may include opposed projecting portions received in the opposed channels of the side wall members for guiding movement of the platform from a retracted position to an extended position relatively adjacent the dispensing opening.

In an embodiment, at least one of the channels are closed at a forward end by a cross bar extending between the first and second guide ribs and the platform includes at least one limiter tab (or the projecting portion) that is disposed inside the channel and which contacts the cross bar to limit the platform from moving any further in the rear to forward direction, thereby defining the adjacent most position of the platform. This way of limiting the movement of the platform is relatively easy to manufacture and provides a nicely integrated way of achieving the guide and limit functions for the movement of the platform. It is thus an independently applicable feature with respect to the tab and opening locking mechanism for the lid member.

In an embodiment, the limiter tab is located at a rear side of the thickness of the platform so that the top of the platform extends above the cross bar in the rear to forward direction. In this way, sufficient space is provided in the rear to forward direction from the top of the guide rails in the side of the housing for accommodation of the opening or tab, while the platform is still positioned as close as possible to the dispensing opening.

In an embodiment, the at least one tab is positioned in line with the guide channel in the forward to rear direction.

In an embodiment, the crossbar includes an obstruction or stop member upstanding in the rear to forward direction that limits the degree of deflection of the tab provided with the lid member as the projection of the tab is moved out of the opening provided with the housing. This obstruction member prevents over deflection of the tab beyond its plastic deformation point. Further, the platform limiting and guiding functions and the tab protecting function are provided through a nicely integrated functional complex.

In an embodiment, the housing includes a stop member for limiting inward deflection of the tab or resilient arm to a stop position. In an embodiment, the stop position is located outwardly of an inward projecting extent of stack guiding ribs disposed adjacent the stop member so that the tab does not deflect so far inwardly as to scrunch, crush or otherwise contact the stack of napkins. Also, the stop member prevents over straining of the tab or resilient arm. In an embodiment, the stop member is positioned on a sidewall member of the housing. The stop member is positioned at a border of the opening. In an embodiment, the stop member projects so as to overlap with the opening. In an embodiment, the stop member is integrally moulded or clipped to a side wall member that it is associated with.

In an embodiment, the tab member is attached at one end to the lid member or the housing and projects freely therefrom and includes an arm portion in the direction of projection and a projection portion defining the projection for engaging the recess at the distal end of the arm portion, wherein the stop member is positioned to contact and obstruct movement of a distal end portion of the arm portion. In an embodiment, the stop member has an attached end and a free end, wherein the free end projects to overlap a path of inward deflection of the tab member. In an embodiment, the attached end of the stop member is located at a border of the through opening.

In one embodiment, a plurality of such tab and through openings is provided.

In a fourth aspect, there is provided a tabletop napkin dispenser including a rear wall member and side wall members defining an open ended housing providing an interior space for housing a stack of napkins, and a front member including a dispensing opening that is moveable between a closed position for closing the open end of the housing and an open position providing access to refill napkins in the interior space, wherein at least one, or in some embodiments, a plurality of the side wall members, include a plurality of interiorly protruding ribs that extend in a rear to front direction so that the ribs are presented to the interior space to guide the stack of napkins.

Such ribs have been found to maintain stack integrity and allow the dispenser to be oriented for horizontal or vertical dispensing.

In an embodiment, the ribs protrude by an amount of 5 mm or more, 6 mm or more or 7 mm or more. This size of ribs keeps the stack away from the remainder of the surface of the side wall to guide the stack to the dispensing opening in a vertical and a horizontal dispensing orientation of the dispenser.

In an embodiment, the at least one, or plurality of, side wall members each include 3 or more of such ribs or 4 or more of such ribs. In an embodiment, the ribs are distributed evenly or about evenly across the side wall member. An even distribution of the ribs helps to ensure that the stack contacting and pushing function is achieved across the full extent of the side wall member in a direction along the plane of the side wall member that is perpendicular to the direction of extension of the ribs.

In an embodiment, the ribs for a given side wall member are connected by reinforcement ribs that project interiorly from the side wall member but are set back relative to the extent of protrusion of the ribs. This helps achieve a reinforcement function, while minimising any stack contact by the cross members. Stack contact by the reinforcement ribs tends to disturb stack integrity, particularly when the dispenser is oriented for vertical dispensing. In an embodiment, the reinforcement ribs are at least 1 mm, 2 mm, or 3 mm less interiorly projecting than the guide ribs. The reinforcement ribs may be cross-wise members with respect to the guide ribs, such as diagonally extending relative to the rear to front direction. In an embodiment, the guide ribs are aligned with or are parallel with a central rear to front axis of the dispenser.

In an embodiment, the reinforcement ribs extend across a major extent (such as at least 80%, 90% or even entirely) of the sidewall member and the guide ribs extend along a major extent (such as at least 80%, 90% or even entirely) of the sidewall member. In an embodiment, the side wall member is an injection moulded piece and the reinforcement and guide ribs are integrally injection moulded therewith. In an embodiment, the reinforcement ribs are provided in a criss-cross pattern.

In an embodiment, the front member is provided by a drawer that is slideable relative to the open ended housing between the closed and open positions. In an embodiment, the movement of the drawer is guided by cooperating rails and channels disposed on opposed sides of the drawer. A rail or channel counterpart is provided on an inside surface of opposed first and second side wall members. Third and/or fourth opposed side wall members of the housing each include said ribs. The first, second, third and fourth side wall members respectively make up the four sides of a generally oblong shaped open ended housing.

In an embodiment, the drawer and the channel and rail structures are such that the drawer is slideable between the open and closed position in a first orientation and also in an upside down orientation. In such an embodiment, the third and the fourth side wall members include the ribs so that the ribs are in contact with the stack of dispensers in both orientations and a tray of the drawer upon which the stack is disposed rides along the ribs on the opposed side wall member.

In an embodiment, the drawer is open at a surface opposite to a tray member of the drawer so that the stack held on the tray member is able to come into contact with the ribs on the corresponding side wall member positioned against the open surface of the drawer, to thereby guide the stack.

In an embodiment, the ribs at one or both of the opposite ends are tapered to merge with the remainder of the surface of the side wall member. This feature ensures that the ribs do not offer any harsh, potentially snagging surfaces.

In a fifth aspect, there is provided a lid member for a chute of a napkin dispenser that is designed for movement between open and closed positions relative to the chute, wherein the lid member includes a dispensing opening through which napkins are withdrawn from the chute and at least one transparent window through which napkins in the chute are viewable to allow a napkin stack low condition to be observed from outside of the napkin dispenser through the window.

In an embodiment, the at least one transparent window includes a transparent window disposed on one or both sides of the dispensing opening. The at least one transparent window may be disposed on a side of the dispensing opening in a direction perpendicular to a longitudinal axis of the dispensing opening with respect to the dispensing opening being elongate. The lid member may be curved and the at least one window disposed on the curve, so that with a front surface of a stack of napkins pressed against a rear surface of the lid member and the dispensing opening, the at least one transparent window reveals an end portion of the stack in the stacking direction of the napkins. That is, the transparent window is rearwardly disposed as a result of the lid member curvature relative to the dispensing opening.

In an embodiment, a body of the lid member is opaque so that the lid member is partly transparent and partly opaque when viewed from the outside. In an embodiment, the body provides an opaque frame about the dispensing opening. In an embodiment, the body and the window are separate pieces attached together, for example, separately injection moulded pieces. In an embodiment, the body and the window pieces include peripheral interfaces surfaces that overlap with one another that are provided with an adhesive layer to attach the pieces together.

In an embodiment, the lid member includes curved outer portions relative to an inwardly disposed central portion so that the dispensing opening is at an apex of the lid member relative to the outer portions, wherein at least one of the outer portions are transparent to provide the at least one window. This feature allows a thickness direction of the stack to be observed through the window to enable better determination of the product low condition. In an embodiment, the curvature is such that at least 1 cm, 2 cm or 3 cm or more of a stack having a front sheet disposed against the dispensing opening can be viewed through the window when viewed along a plane extending perpendicularly along a central axis passing through a rear to front direction of the stack.

In an embodiment, a lip piece is also provided, which is attached to the body piece to provide a lip for the dispensing opening. In an embodiment, the lip piece and the body piece are integral with each other and the body piece is separate. In an embodiment, the lip piece is transparent. In an embodiment, the opaque body piece and the transparent window and lip piece(s) are positioned so that the lip area and the window are isolated from one another by an opaque area.

In an embodiment, there is provided a tabletop napkin dispenser including an open ended chute defining an interior area for receipt of a stack of napkins, and a lid member as defined above that is moveable between a closed position relative to the chute and an open position relative to the chute.

The drawer is released by pressing resilient tabs at either side of a dispensing opening. The table top dispenser is made up of four sidewall members and a rear member that clip together. The larger area sidewall members are made up of first and second sidewall plates, the outer of which is see-through so that advertising material disposed in the space between the inner and outer sidewall plates can be seen. The tabletop napkin dispenser includes a platform that is biased by a spring to urge a stack of napkins held in the drawer of the dispenser toward the dispensing opening and away from the base member.

Figure 2:
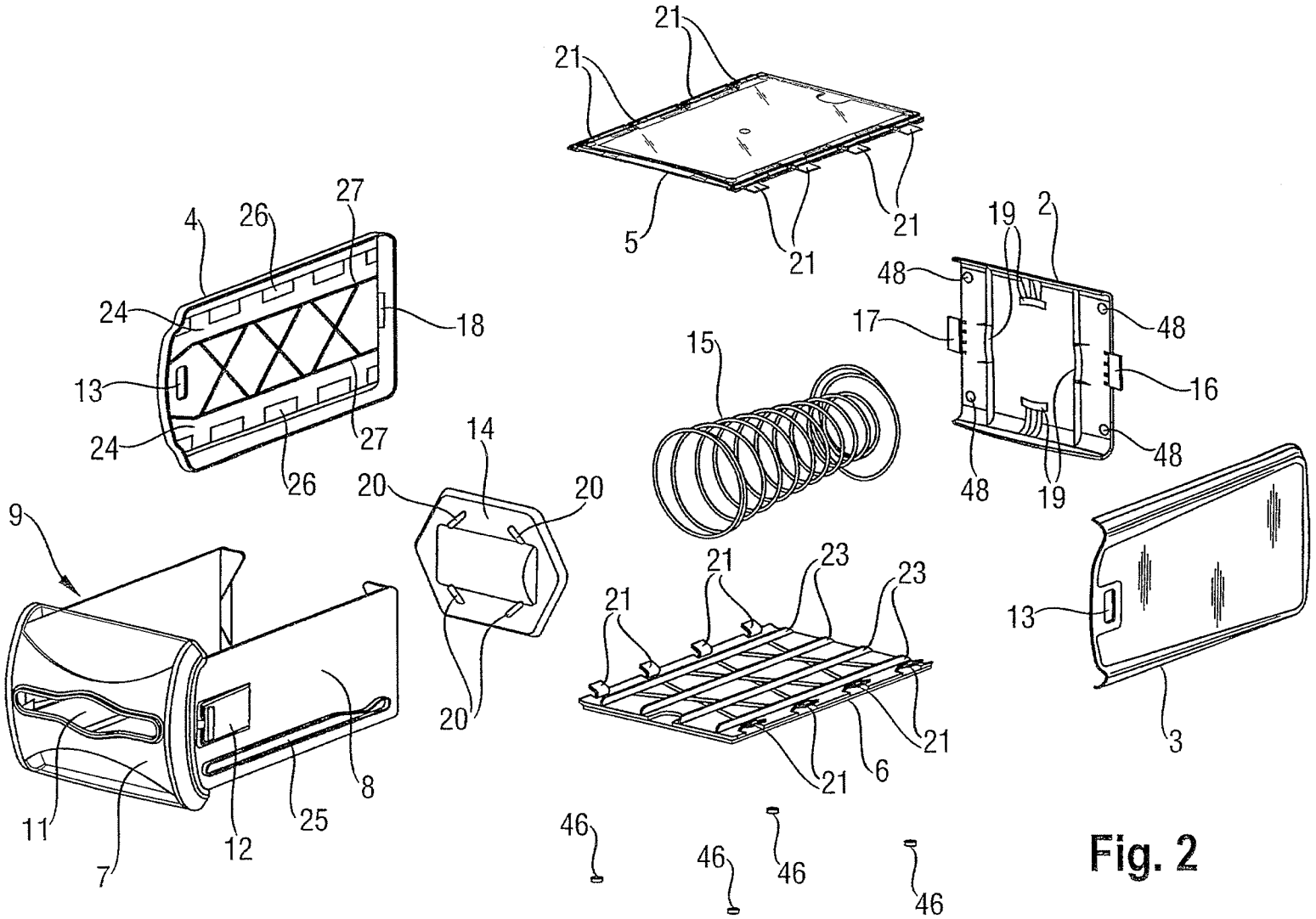

FIG. 2 shows a napkin dispenser in which various components are shown before they have been assembled together. In particular, there is shown a drawer including a front member, first to fourth sidewall members, a base member, a platform and a spring for biasing the platform toward the dispenser opening. The first to fourth sidewall members and the base member clip together to define an open ended box (or chute) for receiving the drawer therein in a slideable manner that is movable between open and closed positions with respect to the open ended box. The spring or biasing member is attached at one end to a front facing surface of the base member and at the other end to a rear facing surface of the platform.

FIG. 3 shows the drawer in detail. The drawer includes a tray member for receiving a stack of napkins and a front member that attaches to the tray member for defining the dispensing opening. The tray member includes resilient tabs that engage with corresponding openings in the sidewall members when the drawer member is in the closed position and which can be depressed in order to release the drawer member from the open ended box to allow it to be retracted to a position for refilling. Walls of the tray member have mounted thereon respective stop members for preventing over inward depression of the resilient tabs.

FIG. 4 discloses a front member of the napkin dispenser in detail. The front member is made of two parts that clip together. A first part provides an opaque frame for the dispensing opening and the portions mounting to the drawer member, while a second part is transparent and defines lips of the dispensing opening as well as filling in side portions of the first part to provide an aesthetically pleasing transparent and opaque mix.

FIG. 5 shows a sidewall member of the napkin dispenser in detail. The napkin dispenser includes first, second, third and fourth sidewall members, two opposed of which define corresponding relatively small areas, and two opposed of which define relatively large areas. FIG. 5 shows the larger area sidewall members in detail. The larger area sidewall member is made up of first and second plates that clip together to define an advertising material receiving space between them. The outer of the plates is transparent, while the inner of the plates is opaque so that the advertising material can be viewed through the transparent plate. Also shown is that the outer plates include four depressions at each corner for receiving respective feet members to stand the napkin dispenser on and for providing a soft interface with the tabletop.

Figure 5B:
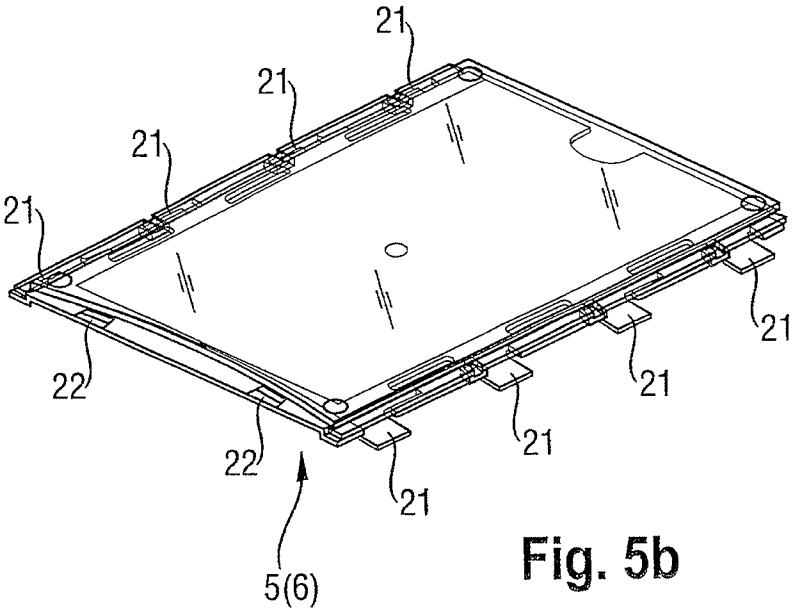
Figure 5A:
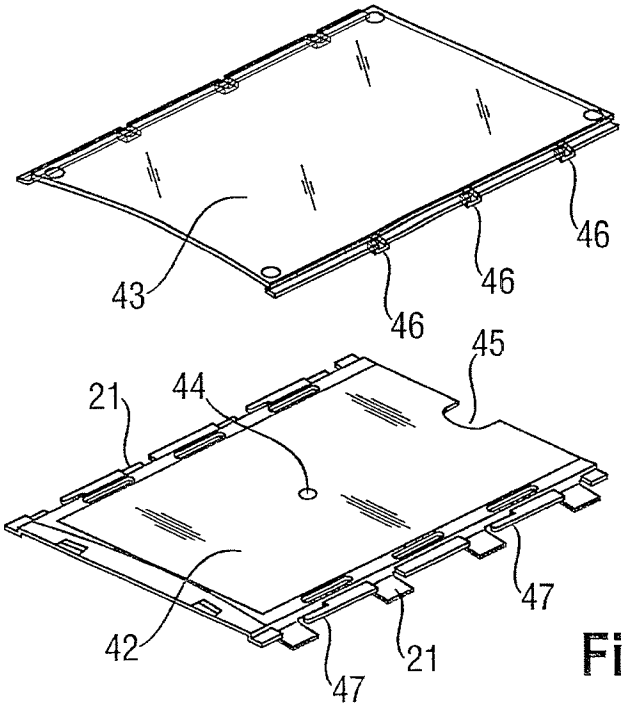
Figure 6:
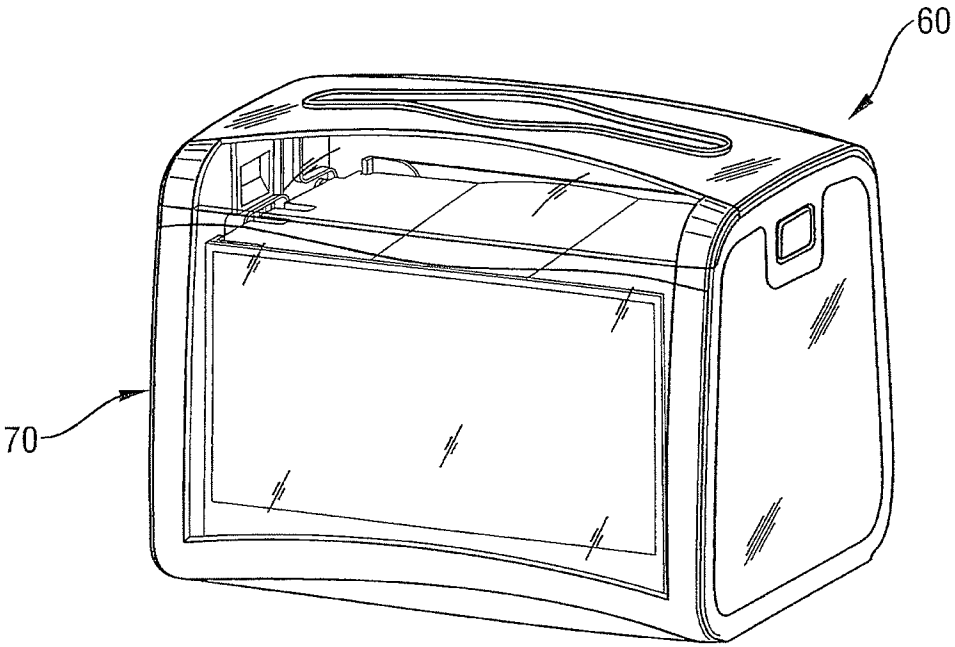

FIG. 6 discloses another embodiment of a tabletop napkin dispenser of a kind in which a rear to front dimension or a stack height capacity dimension is smaller than a length and/or width dimension of the dispenser, which can be compared with the napkin dispenser of FIGS. 1 to 5 wherein the rear to front dimension is greater than a length and width dimension of the napkin dispenser. The napkin dispenser of FIG. 6 is designed to be stood on a rear wall member so that a front wall member and its associated dispensing opening faces upwardly, to define a vertically dispensing dispenser. The napkin dispenser of FIG. 6 further includes four sidewall members connecting the rear wall member and the front wall member, wherein two opposed of the sidewall members are of a larger area than the other two opposed side wall members, so that the napkin defines a generally oblong shape. The front wall member is locked in a closed position with respect to a chute defined by the four sidewall members and a rear wall member and can be released to pivotally open with respect to the chute in order to allow refilling of a napkin reservoir defined by the interior space defined within the four sidewall members and the rear wall member. A platform is disposed within the interior space that is movable between a retracted position and an extended position and is biased by a biasing member to the extended position with respect to the dispensing opening so that the stack of napkins is always disposed adjacent the dispensing opening irrespective of the depletion state of the stack of napkins.

Figure 7:
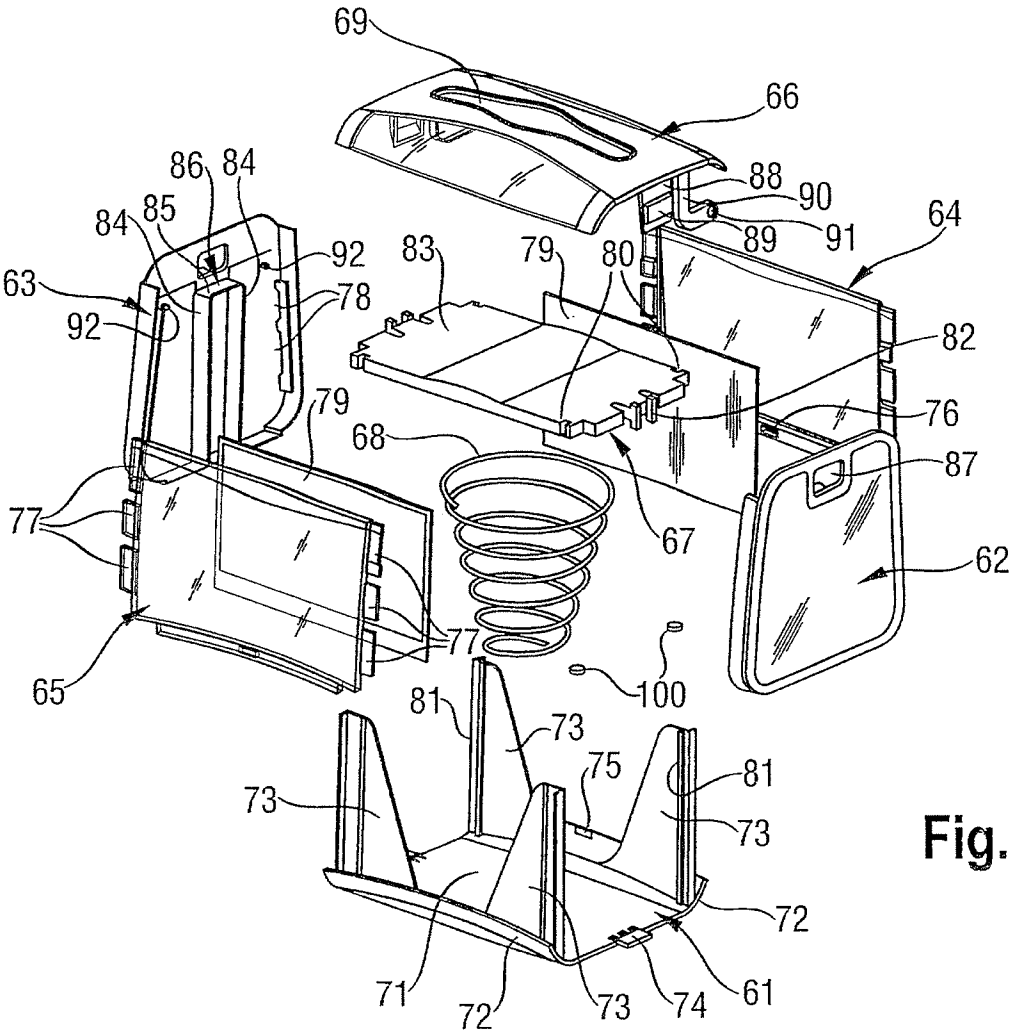

FIG. 7 provides an exploded view of various parts of the napkin dispenser of FIG. 6. This figure shows four sidewall members, the rear wall member and the front wall member as separately injection molded pieces, and the platform. A sheet-sized cavity is disposed between the larger of the sidewall members, which are transparent, and upstanding inner wall members extending normally to a general body of the rear wall member. A stack receiving interior space is defined within inner surfaces of the upstanding inner wall members of the rear wall member and inner surfaces of the inner sidewall members. The platform is received and guided within this space between the retracted and extended positions. Also shown in FIG. 7 are rectangular cards for disposition in the cavity defined in the space between the larger sidewall members and the inner upstanding sidewall members of the rear wall member.

FIG. 8 discloses a two-piece construction for the front or lid member of the tabletop napkin dispenser. An opaque piece includes pivot arms having respective openings therein for receiving pivot protrusions of the smaller sidewall members, to define a pivot axis about which the lid member will rotate between open and closed positions. The opaque piece also includes depending resilient fingers including tab-like protrusions for engagement in respective openings in the smaller sidewall members to allow the lid member to be locked in the closed position when the tab-like projections engage with the openings and to allow the lid member to be released from the locked position for pivoting to the open position when the tab-like projections are depressed by a user from the outside to deflect the resilient arms inwardly to disengage the tab-like projections from the openings. A transparent piece of the lid member defines a lip of the opening of the dispensing opening and also transparent outer portions disposed on either side of the dispensing opening and which extend from one end of the lid member to the other to provide transparent windows for viewing a depletion state of the napkins within the napkin dispenser.

DETAILED DESCRIPTION OF PREFERRED EMBODIMENTS

Figure 1:
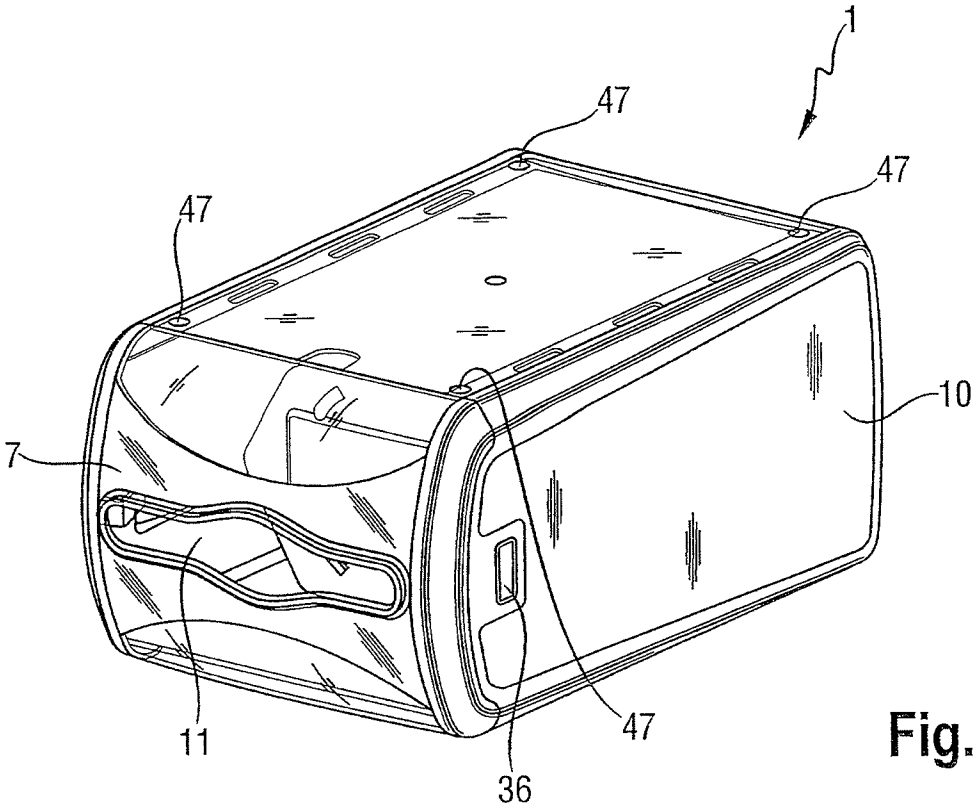
FIG. 1 shows a table top dispenser for dispensing napkins that has a removable drawer for increased napkin capacity.

A perspective view of a table top napkin dispenser according to a first embodiment is shown in FIG. 1. The tabletop napkin dispenser 1 is made up of separately injection molded pieces that are able to be clipped or snap-fit together in order to form the tabletop napkin dispenser 1 shown in FIG. 1. Some of these pieces can be seen in FIG. 2, where there is shown a pre-assembly view of the table top napkin dispenser 1. The tabletop napkin dispenser 1 includes a base member 2, first, second, third and fourth sidewall members 3, 4, 5, 6, a front member 7 and a tray member 8.

The base member 2 and the first, second, third and fourth sidewall members 3, 4, 5, 6 are clipped together in order to form an open ended oblong shaped box or chute 10 for housing a stack of napkins. The tabletop napkin dispenser 1 includes a drawer including a tray member 8 and a front member 7 that defines a dispensing opening 11 that are clipped together. The drawer 9 is movable between a rearward most position in which an open end of the cute 10 is closed by the front member 7 of the drawer 9 and a position in which the drawer 9 is dislocated from the chute 10 for ease of refilling the drawer 9 with napkins.

The dispenser 1 further includes an elongate spring 15 that is connected to a front facing surface of the rear member 2 at one end and is connected to a rear facing surface of the platform 14 at its other end. The platform 14 serves to contact a rear facing surface of a stack of napkins disposed in the drawer 9. The spring 15 is in a more compressed configuration when the drawer 9 is full with napkins and in an extended configuration when the drawer 9 becomes depleted so that the platform 14 biases the stack of napkins to a position adjacent the dispensing opening 11 irrespective of the state of depletion of the stack of napkins.

The first, second, third and fourth sidewall members 3, 4, 5, 6 extend between the rear member 2 and an open end of the chute 10. The first, second, third and fourth sidewall members 3, 4, 5, 6 include first and second sidewall members 3, 4 that have the same length as the third and fourth sidewall members 5, 6 in the rear to front direction, yet have a smaller width in a perpendicular direction to define smaller area rectangular shapes for the first and second sidewall members 3, 4 than the third and fourth sidewall members 5, 6.

The rear member 2 provides a closed rear face to the open ended chute 10 having an open front end. The rear member 2 includes first and second tab-like projections 16, 17 that project from an outer periphery of the rear member 2 to engage in corresponding recesses 18 in a rear end of the first and second sidewall members 3, 4. The first and second tab-like projections 16, 17 project in a sideways direction. By resiliently deflecting the first and second tab-like projections 16, 17 in a rear to forward direction, the corresponding openings 18 on the first and second sidewall members 3, 4 are securely engaged to thereby mount the rear member 2 and the first and second sidewall members 3, 4 together.

The rear member 2 further includes brackets 19 that overlap with a periphery of a rear end of the spring 15 in a rear to front direction in order to connect the spring 15 to the rear member 2. These brackets 19 are provided on a front facing surface of the rear member 2. The platform 14 includes depending members 20 that overlap with a periphery of the spring at the other end in a front to rear direction in order to connect the other end of the spring 15 to the underside of the platform 14.

The larger area third and fourth sidewall members 5, 6 include resilient tab-like members 21 that project sideways from an outer periphery of the sidewall members 5, 6 in order to mount the third and fourth sidewall members 5, 6 to the first and second sidewall members 3, 4. More specifically, the projecting tab-like members 21 resiliently deflect in order to pass into corresponding openings in the first and second sidewall members 3, 4 and resiliently reform into the initial position in order to engage them. As can particularly be seen in FIG. 5*b*, a rear end of the sidewall members 5, 6 include at least one (in the shown embodiment two) snap-fit projections 22 for clipping into counterpart structure in the rear wall member 2. Continuing to refer to FIG. 5*b*, it can be seen that the third and fourth sidewall members 5, 6 include the tab-like projections 21 on both sides thereof so that the third and fourth sidewall members 5, 6 are symmetrical about a central axis extending in a front to rear direction. The symmetrical constructions of the sidewall members 3, 4, 5, 6 allows the first and second sidewall members 3,4 to be interchanged in position with one another with respect to the rear member 2 and likewise the third and fourth sidewall members 5, 6 are interchangeable, yet the tab-like projections 21, the snap-fit projections 22 and the projecting tabs 16, 17 are still aligned with counterpart openings despite the interchange. In this way, manufacture is simplified for a clip together napkin dispenser as the first and second sidewall members 3, 4 and the third and fourth sidewall members 5, 6 do not have to be discriminated from one another. The third and fourth sidewall members 5, 6 include a larger number (four in the shown in embodiment) of outwardly extending projections 21 for securing them to the first and second sidewall members 3, 4 than the rear member 2 (which includes two outwardly extending projecting tabs 16, 17) for engaging the first and second sidewall members 3, 4.

The chute 10 is thus formed by clipping together the rear member 2 and the first to fourth side wall members 3, 4, 5, 6 through protrusions engaging in recesses (which term includes slots), to thereby define a generally oblong shaped chute 10 having one open end.

The third and fourth sidewall members 5, 6 include, on an interior side thereof, a plurality (in the shown embodiment four) of ribs 23 extending longitudinally from a rear end to a front end of the respective sidewall member 5, 6. These ribs protrude by a distance so as to support a tray defining wall of the tray member 8 of the drawer 9 in a low friction manner with respect to the fourth sidewall member 6 and to be able to project into a side face of the stack of napkins held in the drawer 9 to guide the stack of napkins. In one example structure, the ribs 23 project by a distance of about 7 mm. Also shown, but not identified by a reference numeral, are crossbars connecting the guide ribs 23 and diagonally oriented to structurally reinforce the ribs 23.

The first and second sidewall members 3, 4 include structure to guide retraction and extension of the drawer 9. In particular, the first and second sidewall members 3, 4 include channels 24 in an interior facing surface for receiving opposed rails of the drawer 9. The channels 24 extend from a rear end to a front end of the sidewall members 3, 4. The channels 24 are, in the shown embodiment, defined between first and second ribs 26, 27 that extend in a front to rear direction and are spaced apart in a direction perpendicular thereto to provide a space or channel between them for receiving the guide rails 25.

The first and second sidewall members 3, 4 are symmetrically formed with respect to a rear to front central axis passing through the chute 10 so that the first and second sidewall members 3, 4 include an upper and a lower drawer guiding channel 24. This enables the first and second sidewall members 3, 4 to be interchanged with one another for ease of the manufacturing process and also allows the drawer member 9 to be mounted in the orientation shown in FIG. 1 and also in an upside down orientation with respect to the chute 10. In fact, the third and fourth sidewall members 5, 6 are symmetrically formed with respect to the central axis so that they may also be interchanged with one another. In this way, one injection mold can be used for forming both the first and the second sidewall members 3, 4 and one injection mold can also be used for forming both the third and the fourth sidewall members 5, 6.

Turning back to the drawer guiding channels 24 in the first and second sidewall members 3, 4, the more centrally disposed drawer guiding rib 27 is a continuous (or at least more continuous) one, while the other guide rib 26 is discontinuous, formed into a plurality of rib portions spaced in the front to rear direction to provide a low friction interaction with the rails 25 for the rib 26 upon which the weight of the drawer 9 will rest. The discrete rib portions of the drawer guiding rib 26 are co-located with recesses for receiving tab-like projection 21 of the third and fourth sidewall members 5, 6, which provides clearance for moulding the corresponding recesses or slots in the first and second sidewall members 3, 4.

Figure 3B:
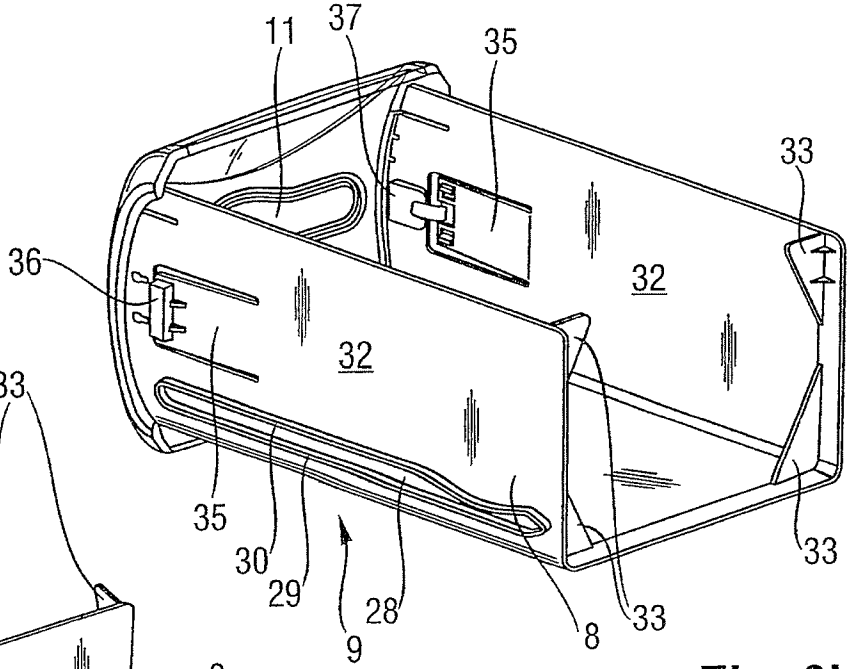
Figure 3A:
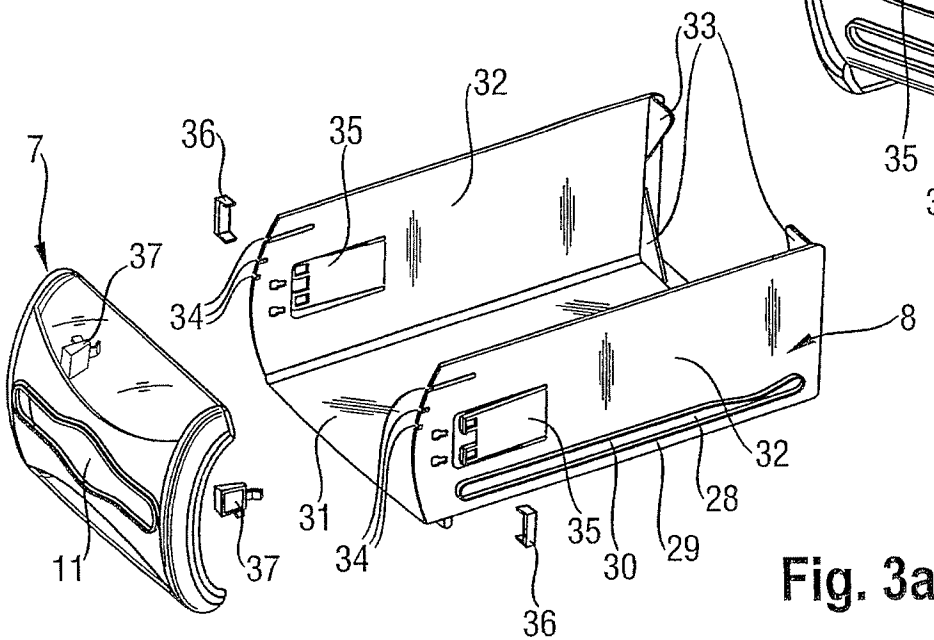

Referring to FIGS. 3*a* and 3*b*, the drawer 9, specifically the tray member 8, includes opposed guide rails 28 that project from an outside of the tray member 8. The guide rails 28 are provided to be accommodated in the opposed guide channels 24 of the first and second sidewall members 3, 4 in order to guide movement of the drawer 9 from a retracted to an extended position with respect to the chute 10. The guide rails 28 are defined by a pair of spaced ribs 29, 30 that extend longitudinally from a rear end to a front end of the drawer 9. These ribs 29, 30 define a relatively deep rail for insertion in the channel 24, while also reducing frictional contact with the first and second sidewall members 3, 4 as compared to a solidly defined rail 28. The first and second guide ribs 29, 30 are, in the shown embodiment, connected at the rear end and the front end to define a continuous loop. The upper guide rib 30 of the guide rail 28 is shaped with a concave depression to allow the drawer to be inserted in an upwardly angled state relative to a central axis passing in a rear to front direction of the chute 10 and, once partly inserted, lowered so that the drawer 9 moves along the axis to the retracted position.

The tray member 8 comprises a base wall 31 and first and second upstanding sidewalls 32 as well as rear corner pieces 33. The stack of napkins is stored in the drawer 9 in an interior space defined by the base wall 31, the upstanding sidewalls 32 and the rear corner pieces 33. The rear corner pieces 33 frame an opening in the rear of the drawer member 8 through which the platform 14 passes as the drawer member 8 is mounted in the chute 10. With the drawer member 8 in the retracted position so that the chute 10 is closed by the front member 7, the platform 14 and spring 15 partially project through the opening framed by the rear corner pieces 33 to contact a rear face of the stack in the drawer 9. Part of the platform 14 and spring 15 will be disposed rearwardly of the rear opening in the drawer 9 in a space in the rear to front direction defined between the corner pieces 33 and the rear member 2.

A front facing surface of the corner pieces 33 provides a surface against which a rear face of the stack of napkins seats when the drawer member 9 is filled with napkins. At least the base wall 31 and the upstanding sidewalls 32 of the tray member 8 are integrally injection molded. The rear wall pieces 33 can be separately injection molded and clipped in place to the sidewalls 32 or can be integrally injection molded with the rest of the tray member 8.

The front of the drawer 9 is provided by a front member 7 that includes the dispensing opening 11. Sidewalls 32 of the tray member 8 include slits 34 extending therethrough and in communication with a front thereof. The front member 7 includes corresponding ribs to provide a mechanical fit between the front member 7 and the tray member 8. In an embodiment, adhesive is also applied between the ribs and the slits 34 to ensure that the front member 7 is securely held to the tray member 8 of the drawer 9. Other attachment mechanisms are possible, including a snap-fit variation. The combination of mechanical fit and adhesive is used for the attachment between the front member 7 and the tray member 8 in one embodiment since this is a heavily handled part of the tabletop napkin dispenser 1 during use.

The drawer 9 includes first and second tabs 12 disposed at a front end portion of the sidewalls 32 that can be deflected into the interior space defined by the tray member 8 to disengage projection tabs 36 from corresponding openings 13 in the first and second sidewall members 3, 4, thereby releasing the drawer 9 from a locked and retracted position for movement into a more extended or removed position relative to the chute 10. The first and second tabs 12 include resilient fingers 35 and projecting tabs 36 disposed at a distal end of the resilient fingers 35. The tab projections 36 are clip-on members with respect to the resilient fingers 35 in order to allow the base wall 31 and the sidewalls 32 and the resilient fingers 35 to be integrally injection molded to form the tray member 8. The guide rail 28 is also an integrally injection molded component of the tray member 8.

The tray member 8 includes stop members 37 to prevent the resilient fingers 35 from extending too far inwardly in order to prevent the resilient fingers 35 from damaging the stack of napkins and also to prevent overstraining of the resilient fingers 35. The stop members 35 are provided by way of an obstructing surface in the path of the inward deflection of the resilient fingers 35. In the shown embodiment, the stop members 37 are mounted to the sidewalls 32 of the tray member 8 at a distal end of the resilient fingers 35 and which include a projection disposed in the path of an inward deflection of the resilient fingers 35. The stop members 35 are formed in a ramped manner in that they taper to merge into the sidewalls 32 in a rearward direction and project further beyond the sidewalls 32 in a forward direction to guide the napkins toward the dispensing opening 11. The stop members 37 are separately formed from the tray member 9 and snap-fit to the sidewalls 37, which again allows the tray member 9 to be injection molded, while still allowing functional components such as the stop members 37 to be provided in a low complexity manufacturing manner.

Figure 4B:
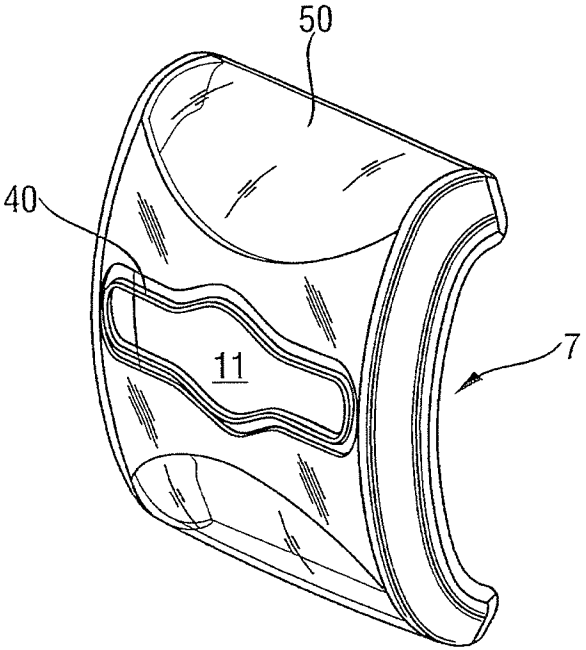
Figure 4A:
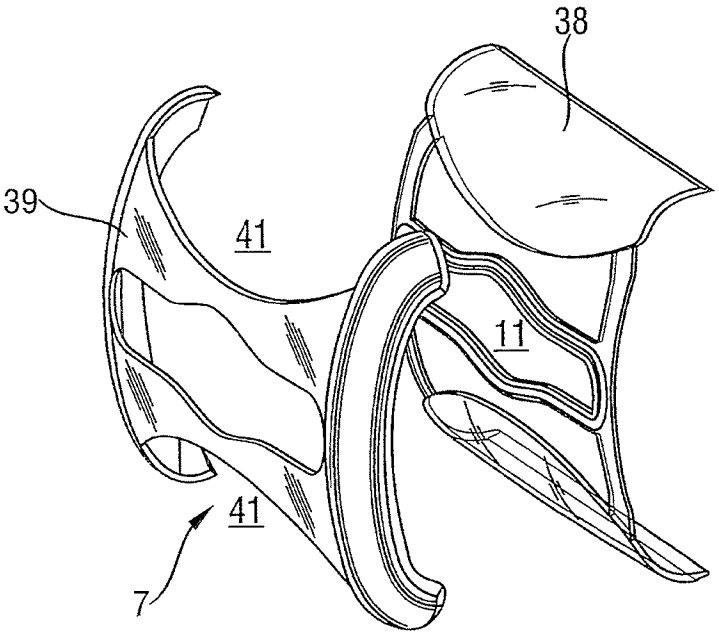

Referring to FIGS. 4*a* and 4*b*, the front member 7 includes a transparent part 38 and an opaque part 39. These parts 38, 39 are attached together to provide a partially opaque and partially transparent front member 7. The transparent and opaque parts 38, 39 may, in one embodiment, be adhesively attached to one another. The transparent part 38 forms a lip 40 around a frame to the dispensing opening 11 formed by the opaque part 39. The transparent part 38 further fills-in cutout portions 41 defined in the opaque part 39 to form half-moon shaped transparent regions on either side of the dispensing opening 11 in order to allow the stack of napkins to be viewed through the front member 7.

In particular, the front member is curved in profile so that the front member 7 extends from the dispensing opening 11 and curves in a front to rear direction so that a front end thickness of the stack of napkins in the drawer 9 can be viewed. The transparent part 38 includes this curved profile so that the end portion of the front of the stack in a stack height direction of front to rear direction can be viewed therethrough. The dispensing opening 11 is generally slot shaped with an enlarged portion in a central region of the slot. Transparent windows 50 on either side of the dispensing opening 11 provided by the transparent part 38 are elongate and share a longitudinal axis that extends parallel to a longitudinal axis of the slot-like dispensing opening. Since the front end portion of the stack can be viewed through the front member 7, it can be quickly and easily determined when the stack of napkins is in a depleted condition and also provides an intuitive feel to the dispensing operation.

Referring to FIGS. 5*a* and 5*b*, the third and fourth sidewall members 5, 6 are each formed of inner and outer plates 42, 43 that can be clipped together in order to define advertising material receiving space between them. The advertising material receiving space is substantially planar so that it is only large enough to receive sheet like material such as paper or thin cardboard. In order to hold the inner and outer plates 42, 43 slightly apart to define the advertising material receiving space, the inner plate 42 includes an outwardly protruding bump 44. This bump 44 holds open the advertising material receiving space, while also avoiding excessive feeding of the advertising material into the space. The inner and outer plates are separately injection molded parts, which allows the sidewall members 5, 6 and particularly the advertising material space defined by them to be formed in a low complexity manufacturing manner. The inner plate 45 includes a thumb sized cutout so that advertising material held in the space between the inner and outer plates 42, 43 can be retrieved easily from an inside of the chute 10.

The inner and outer plates 42, 43 clip together by way of L-shaped brackets 46 and resilient fingers 47 so that the inner and outer plates 42, 43 can be brought together and partially overlapped in a direction normal to the plates 42, 43 and then moved longitudinally in a front to rear direction so that the L-shaped brackets 46 engage against engagement surfaces on the inner plate 42, whereat the resilient fingers 37 resiliently deflect into engagement with blocking surfaces on the outer plate 43 to prevent the outer plate 43 being moved in a rear to front direction to prevent the reverse operation to the just described mounting operation. The L-shaped brackets 46 are moved into engagement with further blocking surfaces on the inner plate 42 as a result of the relative movement between the inner and outer plates 42, 43 in the front to rear direction to block movement of the outer plate 43 relative to the inner plate 42 in a direction normal to the planes defined by the plates 42, 43. In this way, the combination of the resilient fingers 47 and the L-shaped brackets 46 and the blocking surfaces of the first and second plates 42, 43 lock the inner and outer plates 42, 43 together in a forward to rear direction, a rear to forward direction and in a direction perpendicular to the plane of the plates 42, 43.

Referring now to FIGS. 1 and 2, there is shown feet 46 that can be mounted (e.g. adhesively attached) to corresponding depressions in the third and fourth sidewall members 5, 6 and/or corresponding depressions 48 in the rear wall member 2. The dispenser 1 has depressions in both the third and fourth sidewall members 5, 6 and in the rear wall member 2 so that the tabletop napkin dispenser 1 can be used in a horizontally dispensing orientation, in which case they will be provided in the depressions 47, or in a vertically dispensing orientation, in which case the feet 46 will be provided in the depressions 48 of the rear wall member 2. The feet 46 serve to lift the napkin dispenser 1 from the tabletop surface and are made of a material such as rubber that is softer than the third and fourth sidewall members 5, 6 at the outer surfaces or the rear wall member 2 at the outer surface to provide a soft and scratch free interaction with the tabletop surface.

A refilling operation for the napkin dispenser 1 and a dispensing operation for the napkin dispenser 1 will now be described with reference to FIGS. 1 to 5.

In order to refill the napkin dispenser 1, the projections 36 of the tabs 12 on either side of the dispensing opening 11 can be pressed inwardly to resiliently deflect the resilient fingers 35 to take the tab projections 36 out of engagement with the openings 13 in the first and second sidewall members 3, 4. In this way, the drawer 9 for housing a stack of napkins is released from a locked and closed position with respect to the chute 10 of the napkin dispenser 1. Once unlocked, the drawer 9 can be retracted with respect to the chute 10 by pulling the front member 7 forward while holding the projections 36 of the tabs 12 in the inwardly deflected, released position.

The drawer 9 can be continued to be retracted until it is entirely removed from the confines of the chute 10 by sliding the guide rails 25 on either side of the drawer 9 along the guide channels 24 in the first and second sidewall members 3, 4. Once removed, the drawer 9 can be filled with napkins by aligning a stack height of the napkins with a rear to front direction of the drawer 9 so that a rear face of the stack of napkins is positioned against the rear wall pieces 33 of the drawer 9 and so that a front face of the stack of napkins is aligned with the front member 7 of the drawer 9.

In order to reinsert the drawer 9 into the open ended chute 10, the rear of the drawer 9 is inserted into the open end of the chute 10 so that the guide rails 25 enter the guide channels 24. In order to ease this mounting process, the guide rails 25 may include an angled portion at a rear end thereof in order to allow the drawer 9 to be angled with respect to a central axis passing in a front to rear direction of the chute 10. Once the guide rails 25 have begun running in the guide channels 24, the drawer 9 is brought into an aligned position with the central axis and moved to a rearward position so that the front member 7 seats flush against a front end of the chute 10 to close the open end of the chute 10, whereat the projections 36 of the tabs 12 enter the openings 13 under resilient reformation of the resilient fingers 35 in order to lock the drawer member 9 in the retracted position.

In passing the drawer 9 through the open end of the chute 10, the opening in the rear end of the drawer 9 defined by the pieces 33 being arranged in a frame shape around the opening allows the platform 14 to pass at least partly through the rear opening in the drawer 9 to engage against a rear face of the stack. As the drawer 9 is moved into the retracted position, and with the platform 14 pressed against a rear end of the stack, the platform 14 is moved to the rear end of the chute 10, which causes the spring 15 to become compressed. As such, the stack of napkins is biased forwardly in the drawer 9 to a position adjacent the dispensing opening 11 when the drawer 9 is in the locked and retracted position.

If desired, a sheet of advertising material can be fed between the inner and outer plates 42, 43 of the third and/or fourth sidewall members 5, 6. As desired, rubber feet can be mounted (e.g. stuck) in corresponding depressions 47 at the corners of outer surfaces of one of the third or fourth sidewall members 5, 6 or the rear wall member 2 depending upon whether horizontal or vertical dispensing is to be implemented.

Napkins contained in the drawer 9 when the drawer 9 is in the locked and retracted position can be withdrawn through the dispensing opening 11 so that they come into contact with the transparent lip 40 as they are withdrawn. The lip forming piece 38 can be made of a different material such as one having a greater frictional interaction with the napkins, in order to ensure one at a time dispensing. As the stack depletes, there will come a point at which the platform or at least the rear extent of the stack of napkins can be viewed through the transparent windows 50 disposed on either side of the dispensing opening 11 at rearwardly curving parts of the front member 7 or where the rearward curve in combination with the transparent windows 50 allows an end portion, such as at least ten napkins, pressed against the front member 7 to be viewed.

As the stack of napkins depletes, the platform 14 moves under the force of the biasing spring 15 toward the front member 7 to ensure that a napkin is disposed at the dispensing opening 11 for as long as napkins remain in the stack stored in the drawer 9. The stack of napkins will generally be interfolded so that as a front-most napkin is withdrawn through the dispensing opening 11 for use, the adjacent napkin in the stack is partly pulled through the dispensing opening 11 with it for grasping for the next use.

A further embodiment of a tabletop dispenser is shown in FIG. 6. FIG. 6 discloses a tabletop napkin dispenser 60, which can be seen in exploded view in FIG. 7.

The tabletop napkin dispenser comprises a rear wall member 61, first and second sidewall members 62, 63 and third and fourth sidewall members 64, 65. The rear wall member 61 and the first to fourth sidewall members 62-65 are separately injection molded pieces that are able to clip together in order to provide a chute 70 that is closed other than an open front end. A lid member 66 is pivotally attached to the chute 70 between an open position that gives access to the open front end of the chute 70 and a closed position that closes the front open end of the chute 70 so that napkins disposed within an interior spaced defined by the chute 70 are removed through the dispensing opening 69 of the lid member 66.

The rear wall member 61 includes a flat inner surface 71 that will extend parallel to the plane of the tabletop when the dispenser stands on the rear wall member 61. Side parts curve upwards to define a curved rim 72 to long sides of the rear wall member 61. Further, upstanding inner side walls 73 extend normally to the flat surface 71 and define inner and outer surfaces that are parallel to the inner and outer surface of the inner and outer surfaces of the larger sidewall members 64, 65.

First and second projecting tabs 74 extend from the edges of the smaller sides of the rear wall member 61. The first and second projecting tabs 74 engage with recesses disposed in a bottom of the first and second smaller sidewall members 62, 63, in order to secure the rear wall member 61 thereto. A projection 75 is also disposed on inner surface of the curved rims 72 between an outer surface of the upstanding sidewalls 72 and the long side edge of the rear wall member 61 at a location centrally disposed along the long side edge. These projections 75 engage with corresponding recesses 76 disposed at a rear end of the third and fourth sidewall members 64, 65. Further, the third and fourth sidewall members 64, 65 include tabs 77 projecting from the smaller sides thereof to engage in corresponding recesses 78 provided in the smaller sidewall member 62, 63. The recesses 78 are defined by rails protruding normally from a general body of the first and second sidewall members 62, 63 inwardly that include slots or recesses 78 disposed therethrough. In this way, the chute 70 is formed from five separately injection molded pieces 61 to 65 that snap-fit together through protrusions engaging in recesses in a counterpart engagement member.

A cavity is disposed in a space between inner surfaces of the third and fourth sidewall members 64, 65 and outer surfaces of the upstanding inner sidewalls 73 of the rear wall member 61 that is sheet or card shaped for receiving advertising material such as the cards 79 shown in FIG. 7. The outer sidewall members 64, 65 are transparent so that advertising or other information on the cards 79 can be viewed through the third and fourth sidewall members 64, 65 from the outside of the napkin dispenser 60. The upstanding inner sidewalls 73 each include a central cutout that extends from a front end to a rear end and which is larger at the front end than at the rear end to define an upside down isosceles trapezoid shape to the cutout.

The opposing upstanding inner sidewalls 73 of the rear member 61 are thus formed into two discrete portions separated by the cutout. This enables cards 79 to be disposed in the space between the outer surface of the upstanding inner sidewalls 73 and the third and fourth sidewall members 64, 65 that are of smaller height than accommodated by the space and which can still be retrieved from the inside of the dispenser through the cutouts. Yet further, the cutouts extend below a top edge of the curved rim 72, which provides clearance for injection molding the undercuts required to produce the projections 75 that engage with recesses 76 in the third and fourth sidewall members 64, 65.

The platform 67 includes notches 80 at each corner end of the long sides of the platform 67 that extend through the thickness of the platform 67. The notches 80 receive guide ribs 81 that extend from a rear end to a front end of inner surfaces of the upstanding inner sidewalls 73 through which notches 80 and guide ribs 81, movement of the platform 67 from a retracted position adjacent the flat surface 71 of the rear wall member 61 to an extended position adjacent the dispensing opening 69 is guided.

The platform 67 also includes a pair of notches 82 extending through a thickness of the platform 67 on each of the short sides of the platform 67. The pair of notches 82 are spaced apart from each other in a central position on the short sides so as to define a projecting portion 83 between them. The first and second sidewall members 62, 63 are each provided with guide ribs 84 extending from a rear end to adjacent a front end of the respective sidewall member 62, 63. The projecting portions 83 of the platform 67 are received between the guide ribs 84, while the guide ribs 84 are received in the notches 82. In this way, the platform 67 is guided by a guide mechanism provided on each of its four sides, namely by way of notch and rib mechanisms.

The guide ribs 84 on each of the first and second sidewall members 62, 63 are connected at a front end by a cross member connecting rib 85. The cross member connecting rib 85 is positioned rearwardly in the rear to front direction of a front edge of the first and second sidewall members 62, 63 so that through openings 67 extending through a thickness of the first and second sidewall members 62, 63 are located above the cross member connecting rib 85.

The lid member 66 includes depending resilient fingers 88 having tab-like projections 89 disposed at distal ends thereof. The tab-like projections 89 are sized to be received in the through openings 87 of the first and second sidewall members 62, 63 to lock a closed position of the lid member 66. From the outside of the napkin dispenser 60, a user can press the tab-like projections 89 inwardly through the openings 87 to resiliently deflect the resilient fingers 88, to thereby release the lid member 66 for opening. When the lid member 66 is returned to the closed position, the tab-like projections 89 engage against the first and second sidewall members 62, 63 to deflect the resilient fingers 88 inwardly until the tab-like projections 89 align with the through openings 87 at which point the tab-like projections reengage with the through openings 87 under the bias of the resilient fingers 88 to lock the lid members 66.

Stop members 86 project in a rear to front direction from a front facing surface of the cross member connecting rib 85 and are disposed in a path of inward deflection of the resilient fingers 88 to avoid over-inward deflection of the resilient fingers 88. A front facing edge of the stop members 86 is disposed below a bottom edge of the through openings 87. The stop members 86 define a stop position for inward deflection of the resilient fingers 88 such that the resilient fingers 88 cannot be moved inwardly to a position at or beyond the inward extension of the guide ribs 84 of the first and second sidewall members 62, 63 so that the resilient fingers 88 are prevented from coming into contact with, and thus scrunching, the napkins. That is, the inward extent of the guide ribs 84 defines the stack location in a long direction of the platform 67 and the stop members 86 are disposed outwardly of this inward extent to prevent the resilient fingers 88 coming into contact with the stack of napkins.

A spring 68 is disposed between the flat surface 71 of the rear member 61 and a rear facing side of the platform 67. The rear facing side of the platform 67 includes brackets for securing an end of the spring 68. The other end of the spring freely rests against the flat surface 71 of the rear member 61 (although it could be secured thereto by brackets or the like at the cost of some manufacturing simplicity). The retracted position of the platform 67 is defined when a rear side of the platform 67 comes into contact with the flat surface 71 of the rear member 61. An extended position of the platform 67 is defined when a front facing side of the projecting portions 83 of the platform 67 comes into contact with a rear facing side of the cross member connecting rib 85. The spring 68 biases the platform 67 from the retracted position to the extended position so that the napkins are always disposed adjacent the dispensing opening 69 irrespective of the depletion state of the stack of napkins.

The lid member 66 includes first and second pivot arms 90 at either end of the long side of the lid member 66. The first and second pivot arms 90 include pivot openings 91 therethrough at a distal end of the pivot arms 90 that receive pivot projections 92 disposed on an inner surface of the first and second sidewall members 62, 63, respectively. The first and second sidewall members 62, 63 each include first and second pivot projections 92 at a front end portion thereof and symmetrically disposed with respect to a rear to front axis passing centrally between the short sides of the first and second sidewall members 62, 63. In this way, the lid member 66 can be mounted to one side of the first and second side wall members 62, 63 or the other side of the first and second sidewall members 62, 63. In terms of manufacturing, it means that the first and second sidewall members 62, 63 can be identical pieces and interchanged with one another, to simplify the manufacturing process. In fact, the third and fourth sidewall members 64, 65 are formed from the same injection mold as are the first and second sidewall members 62, 63 and are interchangeable with one another in the napkin dispenser 60.

Figure 8B:
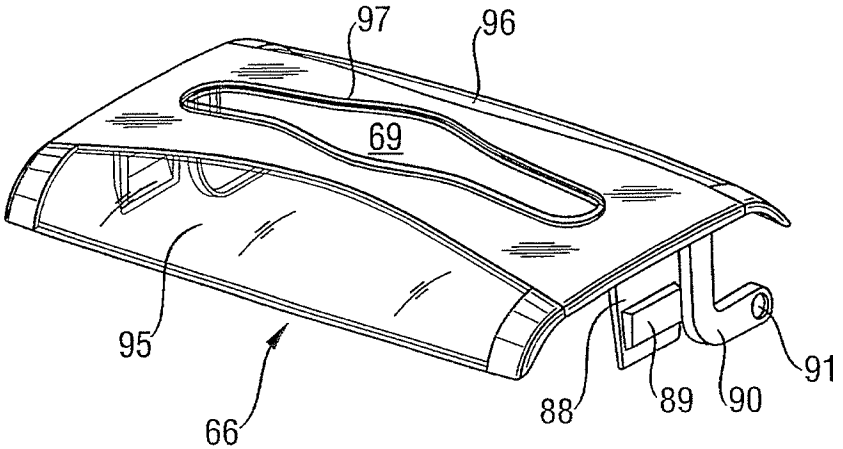
Figure 8A:
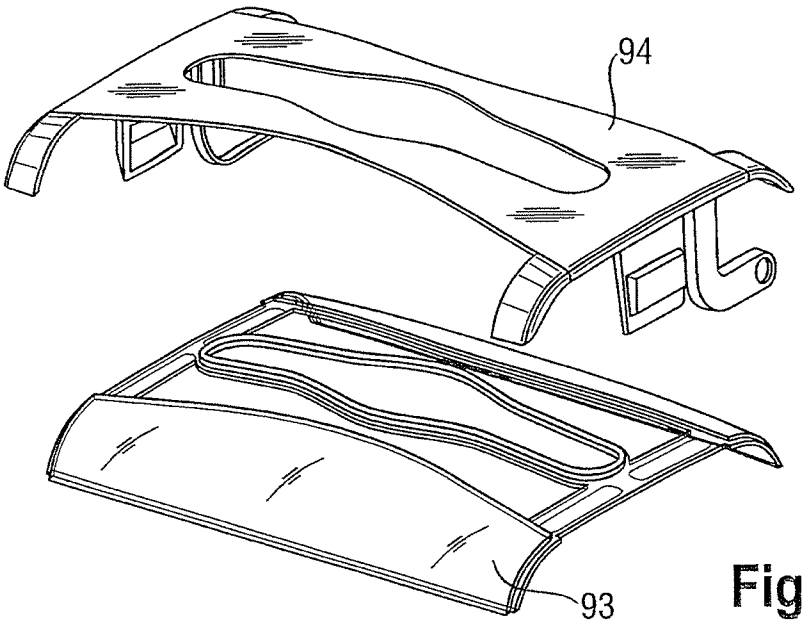

Referring to FIGS. 8*a* and 8*b*, the lid member 66 is a two-piece construction made from separate injection molded pieces 93, 94. There is a transparent piece 93 and an opaque piece 94. The opaque piece 94 includes the pivot arm 90 and the resilient fingers and tab-like projections 88, 89. The transparent piece 93 provides a lip 97 of the dispensing opening 69 and also transparent windows 95, 96 disposed on either side of the dispensing opening 69 and extending along the dispensing opening 69 along a long side of the lip member 66 from substantially at one end to substantially at the other end. The lid member 66 includes a more flattened portion framing the dispensing opening 69 as provided by the opaque piece 94, while the transparent windows 95, 96 curve rearwardly from the more flattened portion so that a depth of the stack of napkins (such as at least 10 napkins) can be seen through the transparent windows 95, 96 so that a user can determine when the stack of napkins is reaching a depleted state. The transparent piece 93 and the opaque piece 94 include overlapping interfacing surfaces that are provided with an adhesive layer to adhere the first and second pieces 93, 94 together.

The napkin dispenser 60 further includes four feet made of a relatively soft material as compared to the first and second sidewall members 62, 63 or the rear wall member 61 that are disposed in respective depressions at corner portions of an outer surface of a rear facing surface of the napkin dispenser 60. The soft feet 100 can be adhesively attached in the depressions. The depressions may be provided on an outer surface of a rear facing surface of the first and second sidewall members 62, 63. The feet 100 provide an interface between the napkin dispenser 60 and the table top surface and lift the remainder of the outer surface of the rear facing surface of the napkin dispenser 60 from the tabletop surface to avoid scratching of the table top surface. The feet 100 may be made of, for example, rubber.

In use, the second embodiment of the tabletop napkin dispenser 60 is stood on the feet 100 on the table top surface. To fill the napkin dispenser 60 with napkins, the tab-like projections 89 protruding into the through openings 87 in the first and second sidewall members 62, 63 are pressed clear of the first and second sidewall members 62, 63 to allow the lid member 66 to be rotated about the pivots 91, 92 so that the lid 66 is moved into a position in which the body of the lid extends substantially parallel and outside of one of the third and fourth sidewall members 64, 65. The lid member 66 is thus moved into an open position exposing the open end of the chute 70.

A stack of napkins can be placed with a rear surface of the stack laying on the front facing surface of the platform 67. To close the lid member 66, the stack and the platform are pushed downwards to the position in which a rear facing surface of the platform 67 contacts the flat forward facing surface 71 of the rear wall member 61 such that that platform 67 is in its retracted position. Movement of the platform 67 is guided by notches 80, 82 and guide ribs 81, 84 on each of the four sides of the platform 67 and by the projecting portion 82 of the platform 67 being disposed between the pair of guide ribs 84 on the first and second sidewall members 62, 63, respectively. With the platform 67 disposed in the retracted position and the stack of napkins thus clear of a forward facing edge of the chute 70, the lid member 66 can be rotated about the pivots 91, 92 into the closed position to close the chute 70.

As the lid member 66 is moved into the closed position, the tab-like projections 89 engage against the first and second sidewall members 62, 63 to inwardly deflect the resilient fingers 88 until the tab-like projections 89 align with the through openings 87 in the first and second sidewall members 82, 83. At which point the resilient fingers force the tab-like projections 89 outwardly into the through openings 87 to lock the closed position of the lid member 66.

The napkins can be removed through the dispensing opening 69 so that they contact the lip 97 provided by the first piece 93 of the lid member 66. The lip 69 may be made of a high friction material with respect to the napkins than the other piece 94 of the lid member 66 so that the napkin adjacent in the stacking order to the napkin being dispensed is better gripped by the dispensing opening to ensure successful one at a time interfolded napkin dispensing operation. As the stack reaches a depleted state, the user is given forewarning by viewing the bottom of the stack or a front facing surface of the platform 67 through the windows 95, 96, to garner an indication that the napkin dispenser 60 is to be refilled.

The napkin dispenser 60 further includes provision for disposing advertising or other information cards in a sheet shaped cavity disposed between the inner surface and the third and fourth sidewall members 64, 65 and the outer surface of the inner sidewalls 73 of the rear member 61. The height of the information cards 79 in the rear to front direction can be designed with flexibility, since the inner sidewalls 73 include a centrally disposed cutout that extends from the front end to the rear end thereof. The cards 79 can include written information, graphics, advertising information or aesthetically pleasing designs that can be viewed through the transparent outer sidewall members 64, 65.

Various modifications can be made to the above-described embodiments.

An example of such modification is that the rails 25 of the drawer 9 shown in FIG. 2 can be provided in split form in that it does not extend continuously from the rear end to the front end of the tray member 8. Instead, the rails 25 could be divided into two or more separate rails distributed from the front end to the rear end of the tray member 8.

In the first embodiment, where ribs 23 are disposed on inner surfaces of the third and fourth sidewall members 5, 6, this could be modified so that only the inner surface of the sidewall members 5, 6 in contact with the stack of napkins when the drawer member 9 is mounted in a predetermined orientation in the chute 10 is provided with the ribs 23. This modification would functionally achieve the stack guiding function, but at the expense of manufacturing flexibility since the third and fourth sidewall members 5, 6 would not then be interchangeable.

In the first embodiment, the guide rails 25 of the drawer 9 are provided by upper and lower ribs connected at each end. A solid rail that does not include the space between the first and second ribs and is instead filled in with material could alternatively be provided, at the expense of the low friction arrangement of the first embodiment and weight and material use considerations.

In the drawer 9 of the first embodiment, a rear opening is provided by four corner pieces 33. Each of these four corner pieces 33 is separated from one another. A continuous frame shape could, however, be provided, although this may make it less easy to injection mould the drawer 9.

In the first and second embodiments, the front member 7 or the lid member 66 are made of first and second separate pieces. It is envisaged, however, that four separate pieces could be provided. A first opaque piece as shown in the figures, a second lip providing piece and third and fourth transparent window providing pieces. In this way, the transparent windows would not be connected to the transparent lip by connecting webs as shown in FIGS. 4 and 8.

The invention claimed is:

1. A tabletop napkin dispenser comprising:

a rear wall member and four side wall members that are mounted to the rear wall member to define an open ended box providing a housing for a stack of napkins; and a front member including a dispensing opening, the front member moveable between an open position with respect to the open ended box to provide access for refilling the napkin dispenser and a closed position to close the open end of the box;

wherein the rear wall member and the four side wall members are separate injection molded pieces that are clipped together to form the open ended box;

wherein the sidewall members include first and second opposed sidewall members that are identical pieces in that they are formed by the same first injection mould and include third and fourth sidewall members that are identical pieces in that they are formed by the same second injection mould;

wherein the first and second sidewall members are interchangeable with one another during assembly of the open ended box, and the third and fourth sidewall members are interchangeable with one another during assembly of the open ended box, yet the sidewall member pieces and the rear member piece would still clip together in the same way to assemble the open ended box if the first and second side wall members were so interchanged and the third and fourth side wall members were so interchanged; and wherein the pieces are clipped together by way of respective projections snap fitting into respective recesses.

2. The napkin dispenser of claim 1, wherein the napkin dispenser includes a platform and a biasing member, the platform being biased by the biasing member toward the dispensing opening so that the platform forces the stack of napkins toward the dispensing opening from a rear side of the stack.

3. The napkin dispenser of claim 2, wherein the platform is provided by a further separate injection molded piece.

4. The napkin dispenser of claim 1, wherein the front member is provided by a lid member that is pivotably mounted to the open ended box for rotation between the open and closed positions.

5. The napkin dispenser of claim 4, wherein first and second opposed side wall members each have first and second pivot members so that the first and second sidewall members are each useable as both a left-hand piece and a right-hand piece of the open-ended box, yet corresponding pivot members engaging counterpart pivot members of the lid member would still be provided even if the first and second sidewall members were interchanged during assembly of the open ended box.

6. The napkin dispenser of claim 1, wherein the rear wall member defines a flat inner surface with respect to a flat tabletop surface upon which the napkin dispenser can stably stand and opposed curved side parts connecting with opposed side walls to give a rounded outer profile to the napkin dispenser.

7. The napkin dispenser of claim 6, wherein the opposed curved side parts include engagement projections that snap fit into engagement recesses in the corresponding side wall members.

8. The napkin dispenser of claim 7, wherein the rear wall member includes upstanding side walls that extend along opposed side wall members and are respectively located on the same side of the rear wall member as the opposed curved side parts of the rear wall member, wherein the upstanding side walls are each formed with cut outs to reveal the engagement projection on the curved side parts as viewed along a plane parallel with the flat base part of the rear wall member.

9. The napkin dispenser of claim 8, wherein the cut outs extend to the front edge of the upstanding side walls and the cut outs reduce in length in a direction along the upstanding side wall from a front end to a rear end of the upstanding side wall.

10. The napkin dispenser of claim 1, wherein upstanding side walls of the rear side wall member extend along the adjacent third and fourth side wall members to define a sheet material receiving cavity, wherein the third and fourth side wall members and the upstanding side walls cooperate to support the sheet material in the cavity, and wherein the third and fourth side wall members are, at least partly, transparent so that the sheet material can viewed from through the respective side wall member from outside the napkin dispenser.

11. The napkin dispenser of claim 1, wherein opposed side wall members are made up of an inner wall member and an outer wall member that are separately injection molded pieces so as to define a cavity between them for receipt of sheet material, wherein the first and second wall members support opposing major surfaces of the sheet material, and wherein the outer wall member is transparent so that the sheet material in the cavity can be viewed from the outside of the napkin dispenser through the outer wall member.

12. The napkin dispenser of claim 11, wherein the inner and outer wall members are held together by the inner wall member including structure to engage on the outer side of the outer wall member or the outer wall member including structure to engage on the inner side of the inner wall member, the structure being such that it is brought into engagement by bringing the inner and outer wall members into contacting yet offset relation and moving the inner and outer wall members along the plane of the wall members relative to one another into an aligned position.

13. The napkin dispenser of claim 12, wherein the inner or outer walls include resilient fingers with projections thereon for receipt in recesses on the other of the inner or outer wall member for locking the aligned position to prevent the reverse of the offset to aligned motion.

14. A tabletop napkin dispenser comprising:

a rear wall member and four side wall members that are mounted to the rear wall member to define an open ended box providing a housing for a stack of napkins; and a front member including a dispensing opening, the front member moveable between an open position with respect to the open ended box to provide access for refilling the napkin dispenser and a closed position to close the open end of the box;

wherein the rear wall member and the four side wall members are separate injection molded pieces that are clipped together to form the open ended box;

wherein the sidewall members include first and second opposed sidewall members that are identical pieces in that they are formed by the same first injection mould and include third and fourth sidewall members that are identical pieces in that they are formed by the same second injection mould;

wherein the first and second sidewall members are interchangeable with one another during assembly of the open ended box, and the third and fourth sidewall members are interchangeable with one another during assembly of the open ended box, yet the sidewall member pieces and the rear member piece would still clip together in the same way to assemble the open ended box if the first and second side wall members were so interchanged and the third and fourth side wall members were so interchanged; and wherein the front member is provided by a drawer that is slideable within the open ended box between the open position and the closed position, the drawer defining a tray for receipt of the stack of napkins.

15. The napkin dispenser of claim 14, wherein the first and second opposed side wall members each include first and second drawer guide channels or guide rails so that the first and second sidewall members are each useable as both a left-hand piece and a right-hand piece of the open-ended box, yet corresponding opposed guide rails or channels fitting with counterpart guide channels or rails of the drawer would still be provided even if the first and second opposed sidewall members were interchanged during assembly of the open-ended box.

16. The napkin dispenser of claim 14, wherein the napkin dispenser includes a platform and a biasing member, the platform being biased by the biasing member toward the dispensing opening so that the platform forces the stack of napkins toward the dispensing opening from a rear side of the stack.

17. The napkin dispenser of claim 16, wherein the platform is provided by a further separate injection molded piece.

18. The napkin dispenser of claim 14, wherein opposed side wall members are made up of an inner wall member and an outer wall member that are separately injection molded pieces so as to define a cavity between them for receipt of sheet material, wherein the first and second wall members support opposing major surfaces of the sheet material, and wherein the outer wall member is transparent so that the sheet material in the cavity can be viewed from the outside of the napkin dispenser through the outer wall member.

19. The napkin dispenser of claim 18, wherein the inner and outer wall members are held together by the inner wall member including structure to engage on the outer side of the outer wall member or the outer wall member including structure to engage on the inner side of the inner wall member, the structure being such that it is brought into engagement by bringing the inner and outer wall members into contacting yet offset relation and moving the inner and outer wall members along the plane of the wall members relative to one another into an aligned position.

20. The napkin dispenser of claim 19, wherein the inner or outer walls include resilient fingers with projections thereon for receipt in recesses on the other of the inner or outer wall member for locking the aligned position to prevent the reverse of the offset to aligned motion.

* * * * *